US011265647B2

(12) United States Patent
Maeno et al.

(10) Patent No.: US 11,265,647 B2
(45) **Date of Patent: *Mar. 1, 2022**

(54) SOUND PROCESSING DEVICE, METHOD AND PROGRAM

(71) Applicant: Sony Corporation, Tokyo (JP)

(72) Inventors: Yu Maeno, Tokyo (JP); Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/863,689

(22) Filed: Apr. 30, 2020

(65) Prior Publication Data

US 2020/0260179 A1 Aug. 13, 2020

Related U.S. Application Data

(63) Continuation of application No. 15/754,795, filed as application No. PCT/JP2016/074453 on Aug. 23, 2016, now Pat. No. 10,674,255.

(30) Foreign Application Priority Data

Sep. 3, 2015 (JP) ..... JP2015-174151

(51) Int. Cl.
*H04R 1/40* (2006.01)
*H04R 3/00* (2006.01)

(52) U.S. Cl.
CPC ..... *H04R 1/40* (2013.01); *H04R 3/00* (2013.01); *H04R 2430/20* (2013.01)

(58) Field of Classification Search
CPC ..... H04R 1/40; H04R 3/00; H04R 2430/20; H04R 1/406; H04S 2400/15
See application file for complete search history.

(56) References Cited

U.S. PATENT DOCUMENTS 5,142,586 A 8/1992 Berkhout
7,817,806 B2 * 10/2010 Nakano ..... H04R 1/406 381/92
9,380,398 B2 6/2016 Mitsufuji
9,445,174 B2 * 9/2016 Virolainen ..... H04S 7/303
(Continued)

FOREIGN PATENT DOCUMENTS

EP 2 540 094 1/2013
EP 3 073 766 9/2016
(Continued)

OTHER PUBLICATIONS

International Search Report and Written Opinion and English translation thereof dated May 10, 2016 in connection with International Application No. PCT/JP2016/060895.
(Continued)

*Primary Examiner* — Brian Ensey
(74) *Attorney, Agent, or Firm* — Wolf, Greenfield & Sacks, P.C.

(57) ABSTRACT

A sound processing device is provided with a correction unit that corrects a sound pickup signal. The sound pickup signal is obtained by picking up a sound with a microphone array. The correction unit corrects the sound pickup signal based on directional information that indicates a direction of the microphone array in spherical coordinates, during the picking up of the sound.

17 Claims, 10 Drawing Sheets

(56) References Cited

U.S. PATENT DOCUMENTS

| | | | | |
|---|---|---|---|---|
| 10,015,615 | B2 | 7/2018 | Mitsufuji et al. | |
| 10,380,991 | B2 | 8/2019 | Maeno et al. | |
| 10,477,309 | B2 | 11/2019 | Mitsufuji | |
| 10,524,075 | B2 | 12/2019 | Maeno et al. | |
| 10,602,266 | B2 | 3/2020 | Mitsufuji | |
| 2005/0259832 | A1 | 11/2005 | Nakano | |
| 2009/0028345 | A1 | 1/2009 | Jung et al. | |
| 2011/0194700 | A1 | 8/2011 | Hetherington et al. | |
| 2013/0032156 | A1* | 2/2013 | Kring | A61B 17/132 128/882 |
| 2013/0128701 | A1 | 5/2013 | Derkx | |
| 2013/0332156 | A1 | 12/2013 | Tackin et al. | |
| 2014/0321653 | A1 | 10/2014 | Mitsufuji | |
| 2015/0170629 | A1 | 6/2015 | Christoph | |
| 2016/0080886 | A1 | 3/2016 | De Bruijn et al. | |
| 2016/0163303 | A1 | 6/2016 | Benattar et al. | |
| 2016/0180861 | A1 | 6/2016 | Masuda | |
| 2016/0198280 | A1 | 7/2016 | Schneider et al. | |
| 2016/0269848 | A1 | 9/2016 | Mitsufuji et al. | |
| 2016/0337777 | A1 | 11/2016 | Tsuji et al. | |
| 2017/0034620 | A1 | 2/2017 | Mitsufuji | |
| 2018/0075837 | A1 | 3/2018 | Maeno et al. | |
| 2018/0249244 | A1 | 8/2018 | Maeno et al. | |
| 2018/0279042 | A1 | 9/2018 | Mitsufuji | |
| 2018/0359594 | A1 | 12/2018 | Maeno et al. | |
| 2019/0198036 | A1 | 6/2019 | Osako et al. | |

FOREIGN PATENT DOCUMENTS

| | | | |
|---|---|---|---|
| JP | 2-503721 | A | 11/1990 |
| JP | H04-132468 | A | 5/1992 |
| JP | 5-284591 | A | 10/1993 |
| JP | 2004-112701 | A | 4/2004 |
| JP | 2005-333211 | A | 12/2005 |
| JP | 2010-062700 | A | 3/2010 |
| JP | 2010-193323 | A | 9/2010 |
| JP | 2013-520858 | A | 6/2013 |
| JP | 2014-090293 | A | 5/2014 |
| JP | 2015-027046 | A | 2/2015 |
| JP | 2015-095802 | A | 5/2015 |
| WO | WO 89/09465 | | 10/1989 |
| WO | WO 2011/104655 | | 9/2011 |
| WO | WO 2015/076149 | | 5/2015 |
| WO | WO 2015/097831 | | 7/2015 |

OTHER PUBLICATIONS

International Search Report and English translation thereof dated Nov. 15, 2016 in connection with International Application No. PCT/JP2016/074453.

Written Opinion and English translation thereof dated Nov. 15, 2016 in connection with International Application No. PCT/JP2016/074453.

International Search Report and English translation thereof dated Feb. 21, 2017 in connection with International Application No. PCT/JP2016/085284.

International Written Opinion and English translation thereof dated Feb. 21, 2017 in connection with International Application No. PCT/JP2016/085284.

International Preliminary Report on Patentability and English translation thereof dated Oct. 26, 2017 in connection with International Application No. PCT/JP2016/060895.

International Preliminary Report on Patentability and English translation thereof dated Mar. 15, 2018 in connection with International Application No. PCT/JP2016/074453.

International Preliminary Report on Patentability and English translation thereof dated Jun. 21, 2018 in connection with International Application No. PCT/JP2016/085284.

Ahrens et al., An Analytical Approach to Sound Field Reproduction with a Movable Sweet Spot using Circular Distributions of Loudspeakers, Proceedings of the IEEE International Conference on Acoustics, Speech, and Signal Processing, ICASSP, 2009, pp. 273-276.

Ahrens et al., Applying the Ambisonics Approach on Planar and Linear Arrays of Loudspeakers, Proc. of the 2nd International Symposium on Ambisonics and Spherical Acoustics, May 6-7, 2010, Paris, France, 6 pages.

Ando A., Research Trend of Acoustic System based on Physical Acoustic Model [Butsuri Onkyo Model ni Motozuku Onkyo System No. Kenkyu Kogo], NHK Science and Technical Research Laboratories R&D Report, No. 126, Mar. 2011, 35 pages.

Kamado et al., Sound Field Reproduction by Wavefront Synthesis Using Directly Aligned Multi Point Control, AES 40th International Conference, Tokyo, Japan, Oct. 8-10, 2010, 9 pages.

EPO Communication pursuant to Article 94(3) EPC dated Mar. 30, 2020, in connection with European Application No. 16841575.0.

* cited by examiner

SOUND PROCESSING DEVICE, METHOD AND PROGRAM

CROSS-REFERENCE TO RELATED APPLICATIONS

The present application claims the benefit under 35 U.S.C. § 120 as a continuation application of U.S. application Ser. No. 15/754,795, filed on Feb. 23, 2018, which claims the benefit under 35 U.S.C. § 371 as a U.S. National Stage Entry of International Application No. PCT/JP2016/074453, filed in the Japan Patent Office as a Receiving Office on Aug. 23, 2016, which claims priority to Japanese Patent Application Number JP2015-174151, filed in the Japan Patent Office on Sep. 3, 2015, each application of which is hereby incorporated by reference in its entirety. U.S. patent application Ser. No. 15/754,795 issued as U.S. Pat. No. 10,674,255 on Jun. 2, 2020.

TECHNICAL FIELD

The present technology relates to a sound processing device, method and program, and, in particular, relates to a sound processing device, method and program, in which a sound field can be more appropriately regenerated.

BACKGROUND ART

Conventionally, a technology, which acquires an omnidirectional image and sound (sound field) and reproduces contents including this image and sound, has been known.

As a technology relating to such contents, for example, a technology, which prevents visually induced motion sickness and loss of spatial intervals due to blurring of an image obtained by an omnidirectional camera by controlling the image of a wide visual field to smooth the movement of visibility, has been suggested (e.g., see Patent Document 1).

CITATION LIST

Patent Document

Patent Document 1: Japanese Patent Application Laid-Open No. 2015-95802

SUMMARY OF THE INVENTION

Problems to be Solved by the Invention

Incidentally, when an omnidirectional sound field is recorded by using an annular or spherical microphone array, the microphone array may be attached to a mobile body which moves, such as a person. In such a case, since the movement of the mobile body causes rotation and blurring in the direction of the microphone array, the recording sound field also includes the rotation and blurring.

Accordingly, as for the recorded contents, for example, in consideration of a reproducing system with which a viewer can view the contents from a free viewpoint, if rotation and blurring occur in the direction of the microphone array, the sound field of the contents is rotated regardless of the direction in which the viewer is viewing the contents, and an appropriate sound field cannot be regenerated. Moreover, the blurring of the sound field may cause sound induced sickness.

The present technology has been made in light of such a situation and can regenerate a sound field more appropriately.

Solutions to Problems

A sound processing device according to one aspect of the present technology includes a correction unit which corrects a sound pickup signal which is obtained by picking up a sound with a microphone array, on the basis of directional information indicating a direction of the microphone array.

The directional information can be information indicating an angle of the direction of the microphone array from a predetermined reference direction.

The correction unit can be caused to perform correction of a spatial frequency spectrum which is obtained from the sound pickup signal, on the basis of the directional information.

The correction unit can be caused to perform the correction at the time of the spatial frequency conversion on a time frequency spectrum obtained from the sound pickup signal.

The correction unit can be caused to perform correction of the angle indicating the direction of the microphone array in spherical harmonics used for the spatial frequency conversion on the basis of the directional information.

The correction unit can be caused to perform the correction at the time of spatial frequency inverse conversion on the spatial frequency spectrum obtained from the sound pickup signal.

The correction unit can be caused to correct an angle indicating a direction of a speaker array which reproduces a sound based on the sound pickup signal, in spherical harmonics used for the spatial frequency inverse conversion on the basis of the directional information.

The correction unit can be caused to correct the sound pickup signal according to displacement, angular velocity or acceleration per unit time of the microphone array.

The microphone array can be an annular microphone array or a spherical microphone array.

A sound processing method or program according to one aspect of the present technology includes a step of correcting a sound pickup signal which is obtained by picking up a sound with a microphone array, on the basis of directional information indicating a direction of the microphone array.

According to one aspect of the present technology, a sound pickup signal which is obtained by picking up a sound with a microphone array, is corrected on the basis of directional information indicating a direction of the microphone array.

Effects of the Invention

According to one aspect of the present technology, a sound field can be more appropriately regenerated.

Note that the effects described herein are not necessarily limited, and any of the effects described in the present disclosure may be applied.

MODE FOR CARRYING OUT THE INVENTION

Figure 1:
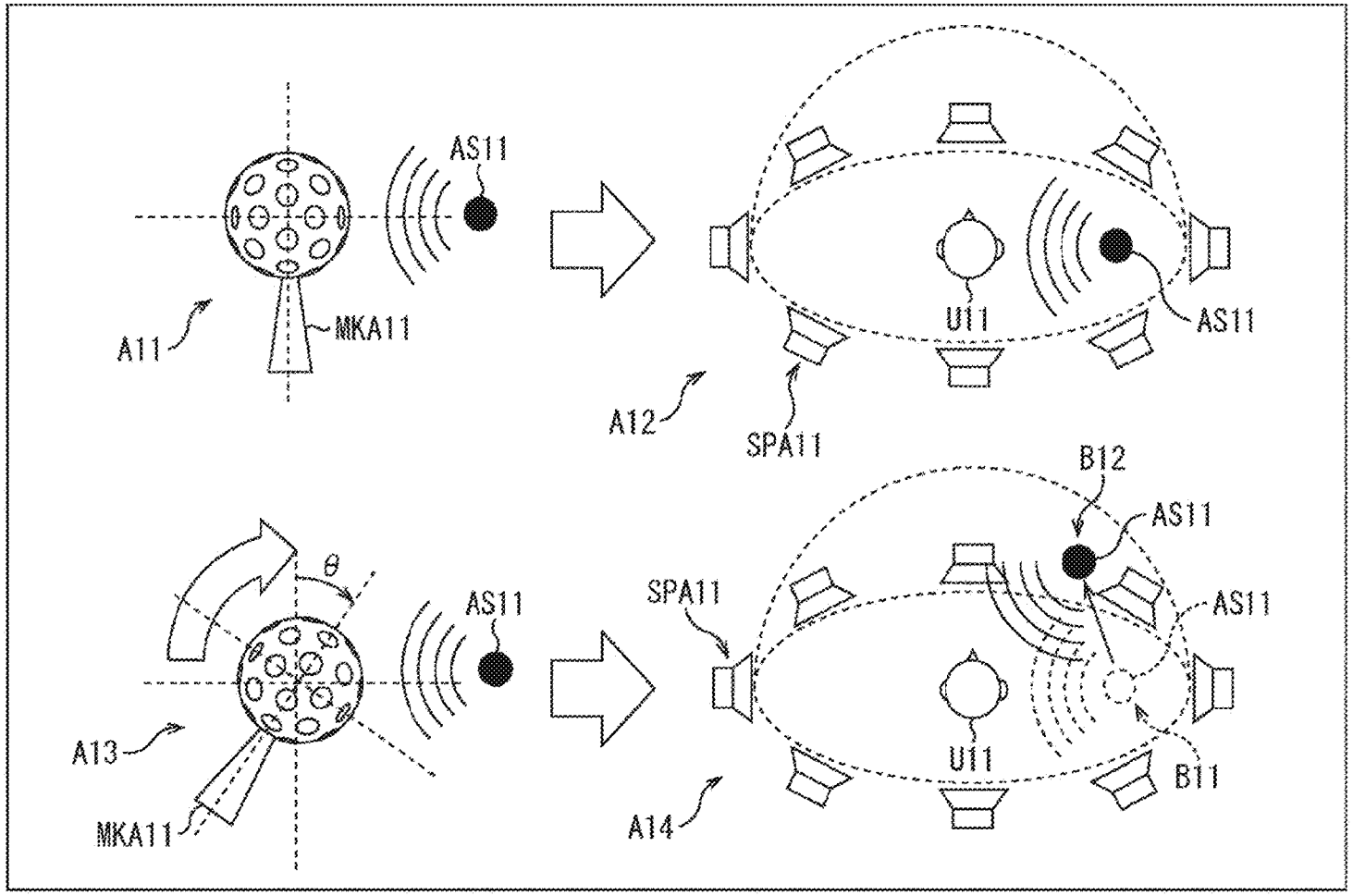
FIG. 1 is a diagram illustrating the present technology.

Hereinafter, embodiments, to which the present technology is applied, will be described with reference to the drawings.

First Embodiment

<About Present Technology>

The present technology records a sound field by a microphone array including a plurality of microphones in a sound pickup space, and, on the basis of a multichannel sound pickup signal obtained as a result, regenerates the sound field by a speaker array including a plurality of speakers disposed in a reproduction space.

Note that the microphone array may be any one as long as the microphone array is configured by arranging a plurality of microphones, such as an annular microphone array in which a plurality of microphones are annularly disposed, or a spherical microphone array in which a plurality of microphones are spherically disposed. Similarly, the speaker array may also be any one as long as the speaker array is configured by arranging a plurality of speakers, such as one in which a plurality of speakers are annularly disposed, or one in which a plurality of speakers are spherically disposed.

For example, as indicated by an arrow A11 in FIG. 11, suppose that a sound outputted from a sound source AS11 is picked up by a microphone array MKA11 disposed and directed in a predetermined reference direction. That is, suppose that a sound field in a sound pickup space, in which the microphone array MKA11 is disposed, is recorded.

Then, as indicated by an arrow A12, suppose that a speaker array SPA11 including a plurality of speakers reproduces the sound in a reproduction space on the basis of a sound pickup signal obtained by picking up the sound with the microphone array MKA11. That is, suppose that the sound field is regenerated by the speaker array SPA11.

In this example, a viewer, that is, a user U11 who is a listener of the sound, is positioned at a position surrounded by each speaker configuring the speaker array SPA11, and the user U11 hears the sound from the sound source AS11 from the right direction of the user U11 at a time of reproducing the sound. Therefore, it can be seen that the sound field is appropriately regenerated in this example.

On the other hand, suppose that the microphone array MKA11 picks up a sound outputted from the sound source AS11 in a state where the microphone array MKA11 is tilted by an angle C with respect to the aforementioned reference direction as indicated by an arrow A13.

In this case, if the sound is reproduced by the speaker array SPA11 in the reproduction space on the basis of the sound pickup signal obtained by picking up the sound, the sound field cannot be appropriately regenerated as indicated by an arrow A14.

In this example, a sound image of the sound source AS11, which should be originally located at a position indicated by an arrow B11, is rotationally moved by only the tilt of the microphone array MKA11, that is, by only the angle θ, and is located at a position indicated by an arrow B12.

In such a case where the microphone array MKA11 is rotated from a reference state or in a case where blurring has occurred in the microphone array MKA11, the rotation and the blurring also occur in the sound field regenerated on the basis of the sound pickup signal.

Thereupon, in the present technology, directional information indicating the direction of the microphone array is used at the time of recording the sound field to correct the rotation and the blurring of the recording sound field.

This makes it possible to fix the direction of the recording sound field in a certain direction and regenerate the sound field more appropriately even in a case where the microphone array is rotated or blurred at the time of recording the sound field.

For example, as a method of acquiring the directional information indicating the direction of the microphone array at a time of recording the sound field, a method of providing the microphone array with a gyrosensor or an acceleration sensor can be considered.

In addition, for example, a device in which a camera device, which can capture all directions or a partial direction, and a microphone array are integrated may be used, and the direction of the microphone array may be computed on the basis of image information obtained by the capturing with the camera device, that is, an image captured.

Moreover, as a reproducing system of contents including at least sound, a method of regenerating a sound field of the contents regardless of a viewpoint of a mobile body to which the microphone array is attached, and a method of regenerating a sound field of the contents from a viewpoint of a mobile body to which the microphone array is attached, can be considered.

For example, correction of the direction of the sound field, that is, correction of the aforementioned rotation is performed in a case where the sound field is regenerated regardless of the viewpoint of the mobile body, and correction of the direction of the sound field is not performed in a case where the sound field is regenerated from the viewpoint of the mobile body. Thus, appropriate sound field regeneration can be realized.

According to the present technology as described above, it is possible to fix the recording sound field in a certain direction as necessary, regardless of the direction of the microphone array. This makes it possible to regenerate the sound field more appropriately in the reproducing system with which a viewer can view the recorded contents from a free viewpoint. Furthermore, according to the present technology, it is also possible to correct the blurring of the sound field, which is caused by the blurring of the microphone array.

<Configuration Example of Recording Sound Field Direction Controller>

Next, an embodiment, to which the present technology is applied, will be described with an example of a case where the present technology is applied to a recording sound field direction controller.

Figure 2:
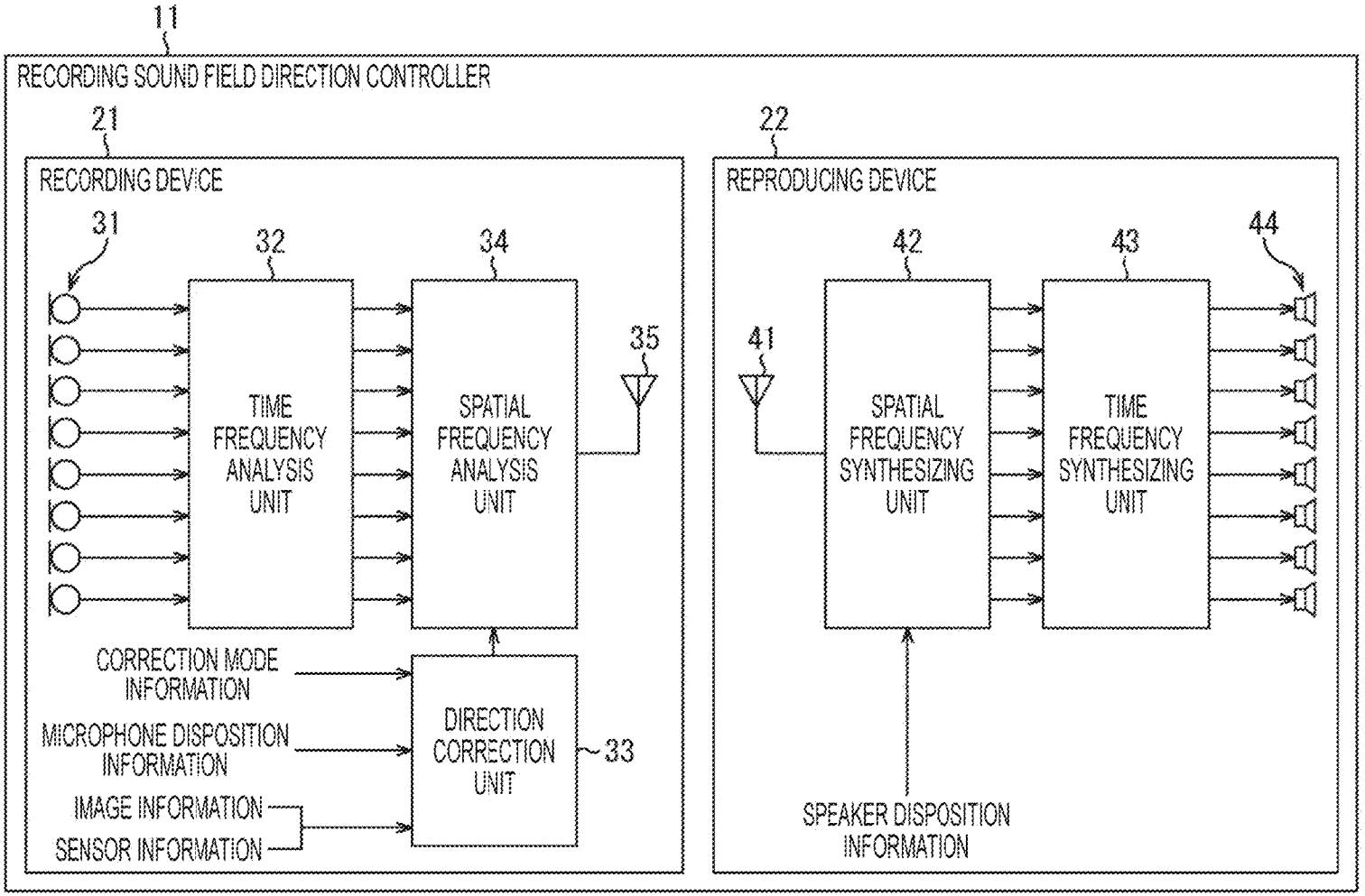
FIG. 2 is a diagram showing a configuration example of a recording sound field direction controller.

FIG. 2 is a diagram showing a configuration example of one embodiment of a recording sound field direction controller to which the present technology is applied.

A recording sound field direction controller 11 shown in FIG. 2 has a recording device 21 disposed in a sound pickup space and a reproducing device 22 disposed in a reproduction space.

The recording device 21 records a sound field in the sound pickup space and supplies a signal obtained as a result to the reproducing device 22. The reproducing device 22 receives the supply of the signal from the recording device 21 and regenerates the sound field in the sound pickup space on the basis of the signal.

The recording device 21 includes a microphone array 31, a time frequency analysis unit 32, a direction correction unit 33, a spatial frequency analysis unit 34 and a communication unit 35.

The microphone array 31 includes, for example, an annular microphone array or a spherical microphone array, picks up a sound in the sound pickup space as contents, and supplies a sound pickup signal, which is a multichannel sound signal obtained as a result, to the time frequency analysis unit 32.

The time frequency analysis unit 32 performs time frequency conversion on the sound pickup signal supplied from the microphone array 31 and supplies a time frequency spectrum obtained as a result to the spatial frequency analysis unit 34.

The direction correction unit 33 acquires some or all of correction mode information, microphone disposition information, image information and sensor information as necessary, and computes a correction angle for correcting a direction of the recording device 21 on the basis of the acquired information. The direction correction unit 33 supplies the microphone disposition information and the correction angle to the spatial frequency analysis unit 34.

Note that the correction mode information is information indicating which mode is designated as a direction correction mode which corrects the direction of the recording sound field, that is, the direction of the recording device 21.

Herein, for example, suppose that there are three types of direction correction modes: a rotation blurring correction mode; a blurring correction mode; and a no-correction mode.

The rotation blurring correction mode is a mode which corrects the rotation and blurring of the recording device 21. For example, the rotation blurring correction mode is selected in a case where reproduction of the contents, that is, regeneration of the sound field is performed while the recording sound field is fixed in a certain direction.

The blurring correction mode is a mode which corrects only the blurring of the recording device 21. For example, the blurring correction mode is selected in a case where reproduction of the contents, that is, regeneration of the sound field is performed from a viewpoint of a mobile body to which the recording device 21 is attached. The no-correction mode is a mode which does not correct either the rotation or the blurring of the recording device 21.

Moreover, the microphone disposition information is angular information indicating a predetermined reference direction of the recording device 21, that is, the microphone array 31.

This microphone disposition information is, for example, information indicating the direction of the microphone array 31, more specifically, the direction of each microphone configuring the microphone array 31 at a predetermined time (hereinafter, also referred to as a reference time), such as a time point of starting the recording of the sound field, that is, the picking up of the sound by the recording device 21. Therefore, in this case, for example, if the recording device 21 is remained in a still state at the time of recording the sound field, the direction of each microphone of the microphone array 31 during the recording remains in the direction indicated by the microphone disposition information.

Furthermore, the image information is, for example, an image captured by a camera device (not shown) provided integrally with the microphone array 31 in the recording device 21. The sensor information is, for example, information indicating the rotation amount (displacement) of the recording device 21, that is, the microphone array 31, which is obtained by a gyrosensor (not shown) provided integrally with the microphone array 31 in the recording device 21.

The spatial frequency analysis unit 34 performs spatial frequency conversion on the time frequency spectrum supplied from the time frequency analysis unit 32 by using the microphone disposition information and the correction angle supplied from the direction correction unit 33, and supplies a spatial frequency spectrum obtained as a result to the communication unit 35.

The communication unit 35 transmits the spatial frequency spectrum supplied from the spatial frequency analysis unit 34 to the reproducing device 22 with or without wire.

Meanwhile, the reproducing device 22 includes a communication unit 41, a spatial frequency synthesizing unit 42, a time frequency synthesizing unit 43 and a speaker array 44.

The communication unit 41 receives the spatial frequency spectrum transmitted from the communication unit 35 of the recording device 21 and supplies the same to the spatial frequency synthesizing unit 42.

The spatial frequency synthesizing unit 42 performs spatial frequency synthesis on the spatial frequency spectrum supplied from the communication unit 41 on the basis of speaker disposition information supplied from outside and supplies a time frequency spectrum obtained as a result to the time frequency synthesizing unit 43.

Herein, the speaker disposition information is angular information indicating the direction of the speaker array 44, more specifically, the direction of each speaker configuring the speaker array 44.

The time frequency synthesizing unit 43 performs time frequency synthesis on the time frequency spectrum supplied from the spatial frequency synthesizing unit 42 and supplies, as a speaker driving signal, a time signal obtained as a result to the speaker array 44.

The speaker array 44 includes an annular speaker array, a spherical speaker array, or the like, which are configured with a plurality of speakers, and reproduces the sound on the basis of the speaker driving signal supplied from the time frequency synthesizing unit 43.

Subsequently, each part configuring the recording sound field direction controller 11 will be described in more detail.

(Time Frequency Analysis Unit)

The time frequency analysis unit 32 performs time frequency conversion on the multichannel sound pickup signal s (i, $n_t$), which is obtained by picking up sounds with each microphone (hereinafter, also referred to as a microphone unit) configuring the microphone array 31, by using discrete Fourier transform (DFT) by performing calculation of the following expression (1) and obtains a time frequency spectrum S (i, $n_{tf}$).

[Expression 1]

$$S(i, n_{tf}) = \sum_{n_t=0}^{M_t-1} s(i, n_t) e^{-j\frac{2\pi n_{tf} n_t}{M_t}} \quad (1)$$

Note that, in the expression (1), i denotes a microphone index for specifying the microphone unit configuring the microphone array 31, and the microphone index i=0, 1, 2, . . . , I−1. In addition, I denotes the number of microphone units configuring the microphone array 31, and $n_t$ denotes a time index.

Moreover, in the expression (1), $n_{tf}$ denotes a time frequency index, $M_t$ denotes the number of samples of DFT, and j denotes a pure imaginary number.

The time frequency analysis unit 32 supplies the time frequency spectrum S (i, $n_{tf}$) obtained by the time frequency conversion to the spatial frequency analysis unit 34.

(Direction Correction Unit)

The direction correction unit 33 acquires the correction mode information, the microphone disposition information, the image information and the sensor information, computes the correction angle for correcting the direction of the recording device 21, that is, the microphone disposition information on the basis of the acquired information, and supplies the microphone disposition information and the correction angle to the spatial frequency analysis unit 34.

For example, each angular information, such as angular information indicating the direction of each microphone unit of the microphone array 31 indicated by the microphone disposition information, and angular information indicating the direction of the microphone array 31 at the predetermined time obtained from the image information and sensor information, is expressed by an azimuth angle and an elevation angle.

Figure 3:
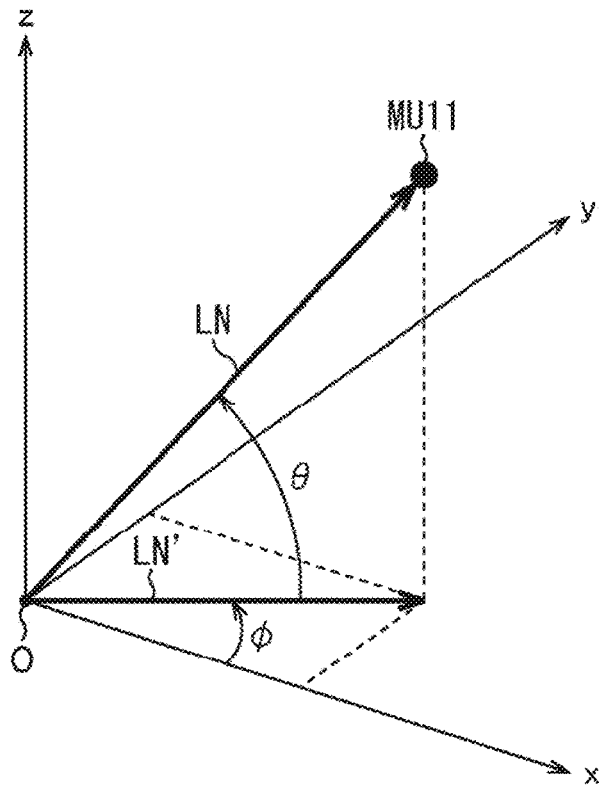
FIG. 3 is a diagram illustrating angular information.

That is, for example, suppose a three-dimensional coordinate system with the origin O as a reference and the x, y, and z axes as respective axes is considered as shown in FIG. 3.

Now, a straight line connecting the microphone unit MU11 configuring the predetermined microphone array 31 and the origin O is set as a straight line LN, and a straight line obtained by projecting the straight line LN from the z-axis direction to the xy plane is set as a straight line LN'.

At this time, an angle ϕ formed by the x axis and the straight line LN' is set as the azimuth angle indicating the direction of the microphone unit MU11 as seen from the origin O on the xy plane. Moreover, an angle θ formed by the xy plane and the straight line LN is set as the elevation angle indicating the direction of the microphone unit MU11 as seen from the origin O on a plane vertical to the xy plane.

In the following description, the direction of the microphone array 31 at the reference time, that is, the direction of the microphone array 31 serving as a predetermined reference is set as the reference direction, and each angular information is expressed by the azimuth angle and the elevation angle from the reference direction. Furthermore, the reference direction is expressed by an elevation angle $\theta_{ref}$ and an azimuth angle $\phi_{ref}$ and is also written as the reference direction ($\theta_{ref}$, $\phi_{ref}$) hereinafter.

The microphone disposition information includes information indicating the reference direction of each microphone unit configuring the microphone array 31, that is, the direction of each microphone unit at the reference time.

More specifically, for example, the information indicating the direction of the microphone unit with the microphone index i is set as the angle ($\theta_i$, $\phi_i$) indicating the relative direction of the microphone unit with respect to the reference direction ($\theta_{ref}$, $\phi_{ref}$) at the reference time. Herein, $\theta_i$ is an elevation angle of the direction of the microphone unit as seen from the reference direction ($\theta_{ref}$, $\phi_{ref}$), and $\phi_i$ is an azimuth angle of the direction of the microphone unit as seen from the reference direction ($\theta_{ref}$, $\phi_{ref}$).

Therefore, for example, when the x-axis direction is the reference direction ($\theta_{ref}$, $\phi_{ref}$) in the example shown in FIG. 3, the angle ($\theta_i$, $\phi_i$) of the microphone unit MU11 is the elevation angle $\theta_i$=8 and the azimuth angle ϕi=ϕ.

In addition, the direction correction unit 33 obtains a rotation angle (θ, ϕ) of the microphone array 31 from the reference direction ($\theta_{ref}$, $\phi_{ref}$) at a predetermined time (hereinafter, also referred to as a processing target time), which is different from the reference time, at the time of recording the sound field on the basis of at least one of the image information and the sensor information.

Herein, the rotation angle (θ, ϕ) is angular information indicating the relative direction of the microphone array 31 with respect to the reference direction ($\theta_{ref}$, $\phi_{ref}$) at the processing target time.

That is, the elevation angle θ constituting the rotation angle (θ, ϕ) is an elevation angle in the direction of the microphone array 31 as seen from the reference direction ($\theta_{ref}$, $\phi_{ref}$), and the azimuth angle ϕ constituting the rotation angle (θ, ϕ) is an azimuth angle in the direction of the microphone array 31 as seen from the reference direction ($\theta_{ref}$, $\phi_{ref}$).

For example, the direction correction unit 33 acquires, as the image information, an image captured by the camera device at the processing target time and detects displacement of the microphone array 31, that is, the recording device 21 from the reference direction by image recognition or the like on the basis of the image information to compute the rotation angle (θ, ϕ). In other words, the direction correction unit 33 detects the rotation direction and the rotation amount of the recording device 21 from the reference direction to compute the rotation angle (θ, ϕ).

Moreover, for example, the direction correction unit 33 acquires, as the sensor information, information indicating the angular velocity outputted by the gyrosensor at the processing target time, that is, the rotation angle per unit time, and performs integral calculation and the like based on the acquired sensor information as necessary to compute the rotation angle (θ, ϕ).

Note that, herein, an example, in which the rotation angle (θ, ϕ) is computed on the basis of the sensor information obtained from the gyrosensor (angular velocity sensor), has been described. However, besides this, the acceleration which is the output of the acceleration sensor, that is, the speed change per unit time may be acquired as the sensor information to compute the rotation angle (θ, ϕ).

The rotation angle (θ, ϕ) obtained as described above is the directional information indicating the angle of the direction of the microphone array 31 from the reference direction ($\theta_{ref}$, $\phi_{ref}$) at the processing target time.

Furthermore, the direction correction unit 33 computes a correction angle (α, β) for correcting the microphone disposition information, that is, the angle ($\theta_i$, $\phi_i$) of each microphone unit on the basis of the correction mode information and the rotation angle (θ, ϕ).

Herein, a of the correction angle (α, β) is the correction angle of the elevation angle $\theta_i$ of the angle ($\theta_i$, $\phi_i$) of the microphone unit, R of the correction angle ($\alpha$, $\beta$) is the correction angle of the azimuth angle $\phi_i$ of the angle ($\theta_i$, $\phi_i$) of the microphone unit.

The direction correction unit 33 outputs the correction angle ($\alpha$, $\beta$) thus obtained and the angle ($\theta_i$, $\phi_i$) of each microphone unit, which is the microphone disposition information, to the spatial frequency analysis unit 34.

For example, in a case where the direction correction mode indicated by the correction mode information is the rotation blurring correction mode, the direction correction unit 33 sets the rotation angle ($\theta$, $\phi$) directly as the correction angle ($\alpha$, $\beta$) as shown by the following expression (2).

[Expression 2]

$$\begin{cases} \alpha = \theta \\ \beta = \phi \end{cases} \tag{2}$$

In the expression (2), the rotation angle ($\theta$, $\phi$) is set directly as the correction angle ($\alpha$, $\beta$). This is because the rotation and blurring of the microphone unit can be corrected by correcting the angle ($\theta_i$, $\phi_i$) of the microphone unit by only the rotation, that is, the correction angle ($\alpha$, $\beta$) of that microphone unit in the spatial frequency analysis unit 34. That is, this is because the rotation and blurring of the microphone unit included in the time frequency spectrum S (i, $n_{tf}$) are corrected, and an appropriate spatial frequency spectrum can be obtained.

Figure 4:
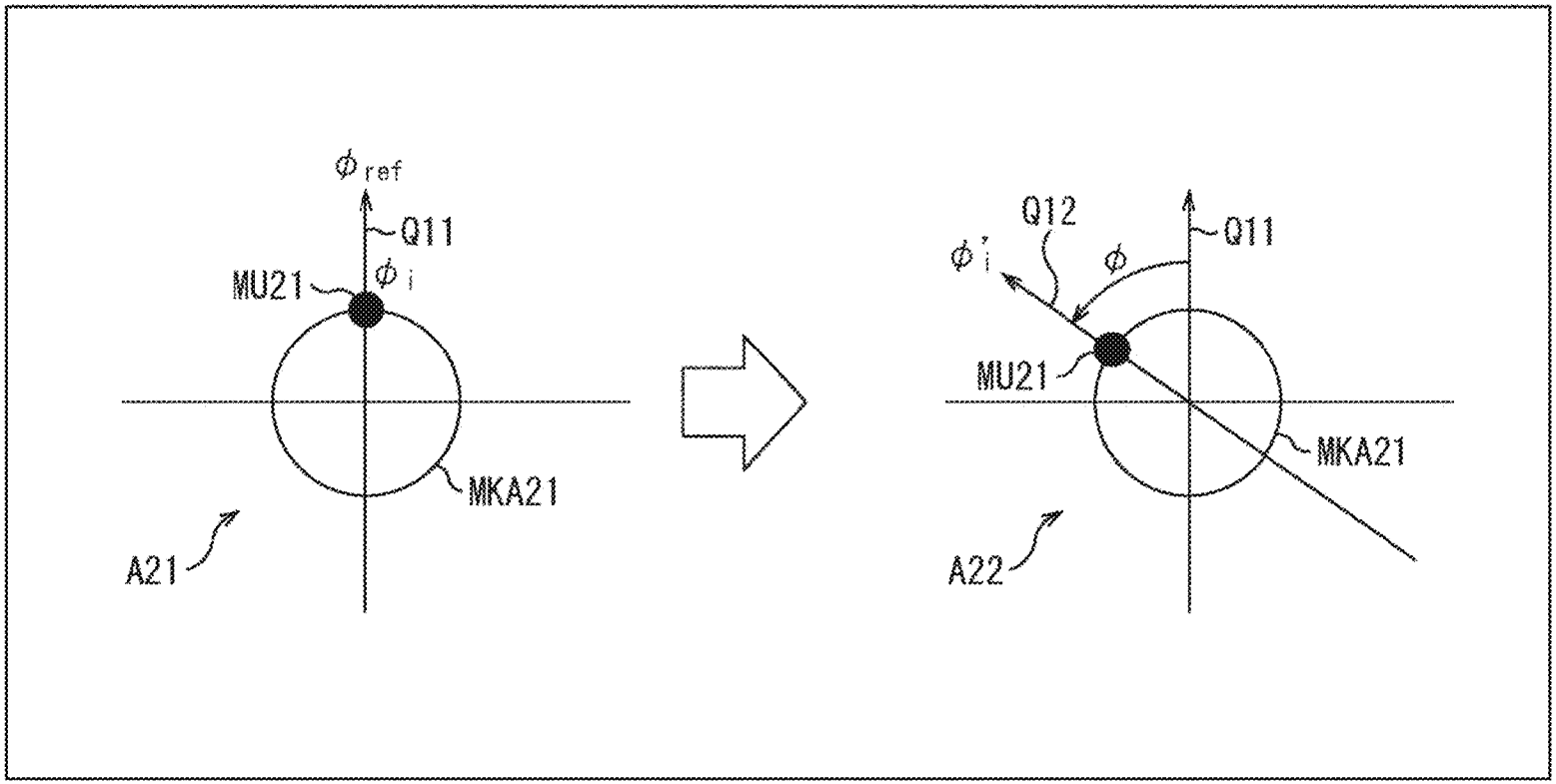
FIG. 4 is a diagram illustrating a rotation blurring correction mode.

Specifically, for example, suppose that attention is paid to an azimuth angle of a microphone unit MU21 configuring an annular microphone array MKA21 serving as the microphone array 31 as shown in FIG. 4.

For example, suppose that, as indicated by an arrow A21, a direction indicated by an arrow Q11 is the direction of the azimuth angle $\phi_{ref}$ of the reference direction ($\theta_{ref}$, $\phi_{ref}$), and the direction of the azimuth angle serving as the reference of the microphone unit MU21 is also the direction indicated by the arrow Q11. In this case, the azimuth angle $\phi_i$ constituting the angle ($\theta_i$, $\phi_i$) of the microphone unit is azimuth angle $\phi_i$=0.

Suppose that the annular microphone array MKA21 rotates as indicated by an arrow A22 from such a state, and the direction of the azimuth angle of the microphone unit MU21 becomes a direction indicated by an arrow Q12 at the processing target time. In this example, the direction of the microphone unit MU21 changes by only an angle $\phi$ in the direction of the azimuth angle. This angle $\phi$ is the azimuth angle $\phi$ constituting the rotation angle ($\theta$, $\phi$).

Therefore, in this example, the angle $\phi$ corresponding to the change in the azimuth angle of the microphone unit MU21 is set as the correction angle $\beta$ by the aforementioned expression (2).

Herein, if the angle after the correction of the angle ($\theta_i$, $\phi_i$) of the microphone unit by the correction angle ($\alpha$, $\beta$) is set as ($\theta_i'$, $\phi_i'$), the azimuth angle of the angle ($\theta_i'$, $\phi_i'$) of the microphone unit MU21 after the direction correction becomes $\phi_i'=0+\phi=\phi$.

In the rotation blurring correction mode, the angle indicating the direction of each microphone unit at the processing target time as seen from the reference direction ($\theta_{ref}$, $\phi_{ref}$) is set as the angle ($\theta_i'$, $\phi_i'$) of the microphone unit after the correction.

Meanwhile, in a case where the direction correction mode indicated by the correction mode information is the blurring correction mode, the direction correction unit 33 detects whether the blurring has occurred in each of the directions, the azimuth angle direction and the elevation angle direction, for the microphone array 31, that is, for each microphone unit. For example, the detection of the blurring is performed by determining whether or not the rotation amount (change amount) of the microphone unit, that is, the recording device 21 per unit time has exceeded a threshold value representing a predetermined blurring range.

Specifically, for example, the direction correction unit 33 compares the elevation angle $\theta$ constituting the rotation angle ($\theta$, $\phi$) of the microphone array 31 with a predetermined threshold value $\theta_{thres}$ and determines that the blurring has occurred in the elevation angle direction in a case where the following expression (3) is met, that is, in a case where the rotation amount in the elevation angle direction is less than the threshold value $\theta_{thres}$.

[Expression 3]

$$|\theta|<\theta_{thres} \tag{3}$$

That is, in a case where the absolute value of the elevation angle $\theta$, which is the rotation angle in the elevation angle direction of the recording device 21 per unit time computed from the displacement, the angular velocity, the acceleration or the like per unit time of the recording device 21 obtained from the image information and the sensor information, is less than the threshold value $\theta_{thres}$, the movement of the recording device 21 in the elevation angle direction is determined as the blurring.

In a case where it is determined that the blurring has occurred in the elevation angle direction, the direction correction unit 33 uses the elevation angle $\theta$ of the rotation angle ($\theta$, $\phi$) directly as the correction angle $\alpha$ of the elevation angle of the correction angle ($\alpha$, $\beta$) as shown in the aforementioned expression (2) for the elevation angle direction.

On the other hand, in a case where it is determined that no blurring has occurred in the elevation angle direction, the direction correction unit 33 sets the correction angle $\alpha$ of the elevation angle of the correction angle ($\alpha$, $\beta$) as the correction angle $\alpha$=0.

Moreover, in a case where it is determined that no blurring has occurred in the elevation angle direction, the direction correction unit 33 updates (corrects) the elevation angle $\phi_{ref}$ of the reference direction ($\theta_{ref}$, $\phi_{ref}$) by the following expression (4).

[Expression 4]

$$\theta_{ref}=\theta_{ref}'+0 \tag{4}$$

Note that the elevation angle $\phi_{ref}'$ in the expression (4) denotes the elevation angle $\phi_{ref}$ before the update. Therefore, in the calculation of the expression (4), the elevation angle $\theta$ constituting the rotation angle ($\theta$, $\phi$) of the microphone array 31 is added to the elevation angle $\phi_{ref}'$ before the update to be a new elevation angle $\theta_{ref}$ after the update.

This is because, since only the blurring of the microphone array 31 is corrected and the rotation of the microphone array 31 is not corrected in the blurring correction mode, the blurring cannot be correctly detected when the microphone array 31 rotates unless the reference direction ($\theta_{ref}$, $\phi_{ref}$) is updated.

For example, in a case where the expression (3) is not met, that is, in a case where $|\theta|>\theta_{thres}$, the rotation amount of the microphone array 31 is large so that the movement of the microphone array 31 is regarded as intentional rotation, not the blurring. In this case, by rotating the reference direction ($\theta_{ref}$, $\phi_{ref}$) by only the rotation amount of the microphone array 31 in synchronization with the rotation of the microphone array 31, the blurring of the microphone array 31 can be detected from the expression (3) with the new updated reference direction ($\theta_{ref}$, $\phi_{ref}$) and the rotation angle ($\theta$, $\phi$) at a next processing target time.

Moreover, in a case where the direction correction mode indicated by the correction mode information is the blurring correction mode, the direction correction unit 33 also obtains the correction angle $\beta$ of the azimuth angle of the correction angle ($\alpha$, $\beta$) for the azimuth angle direction, similarly to the elevation angle direction.

That is, for example, the direction correction unit 33 compares the azimuth angle constituting the rotation angle ($\theta$, $\phi$) of the microphone array 31 with a predetermined threshold value $\phi_{thres}$ and determines that the blurring has occurred in the azimuth angle direction in a case where the following expression (5) is met, that is, in a case where the rotation amount in the azimuth angle direction is less than the threshold value $\phi_{thres}$.

[Expression 5]

$$|\phi|<\phi_{thres} \tag{5}$$

In a case where it is determined that the blurring has occurred in the azimuth angle direction, the direction correction unit 33 uses the azimuth angle of the rotation angle ($\theta$, $\phi$) directly as the correction angle $\beta$ of the azimuth angle of the correction angle ($\alpha$, $\beta$) as shown in the aforementioned expression (2) for the azimuth angle direction.

On the other hand, in a case where it is determined that no blurring has occurred in the azimuth angle direction, the direction correction unit 33 sets the correction angle $\beta$ of the azimuth angle of the correction angle ($\alpha$, $\beta$) as the correction angle $\beta=0$.

Moreover, in a case where it is determined that no blurring has occurred in the azimuth angle direction, the direction correction unit 33 updates (corrects) the azimuth angle $\phi_{ref}$ of the reference direction ($\theta_{ref}$, $\phi_{ref}$) by the following expression (6).

[Expression 6]

$$\phi_{ref}=\phi_{ref}'+\phi \tag{6}$$

Note that the azimuth angle $\phi_{ref}'$ in the expression (6) denotes the azimuth angle $\phi_{ref}$ before the update. Therefore, in the calculation of the expression (6), the azimuth angle constituting the rotation angle ($\theta$, $\phi$) of the microphone array 31 is added to the azimuth angle $\phi_{ref}'$ before the update to be a new azimuth angle $\phi_{ref}$ after the update.

Figure 5:
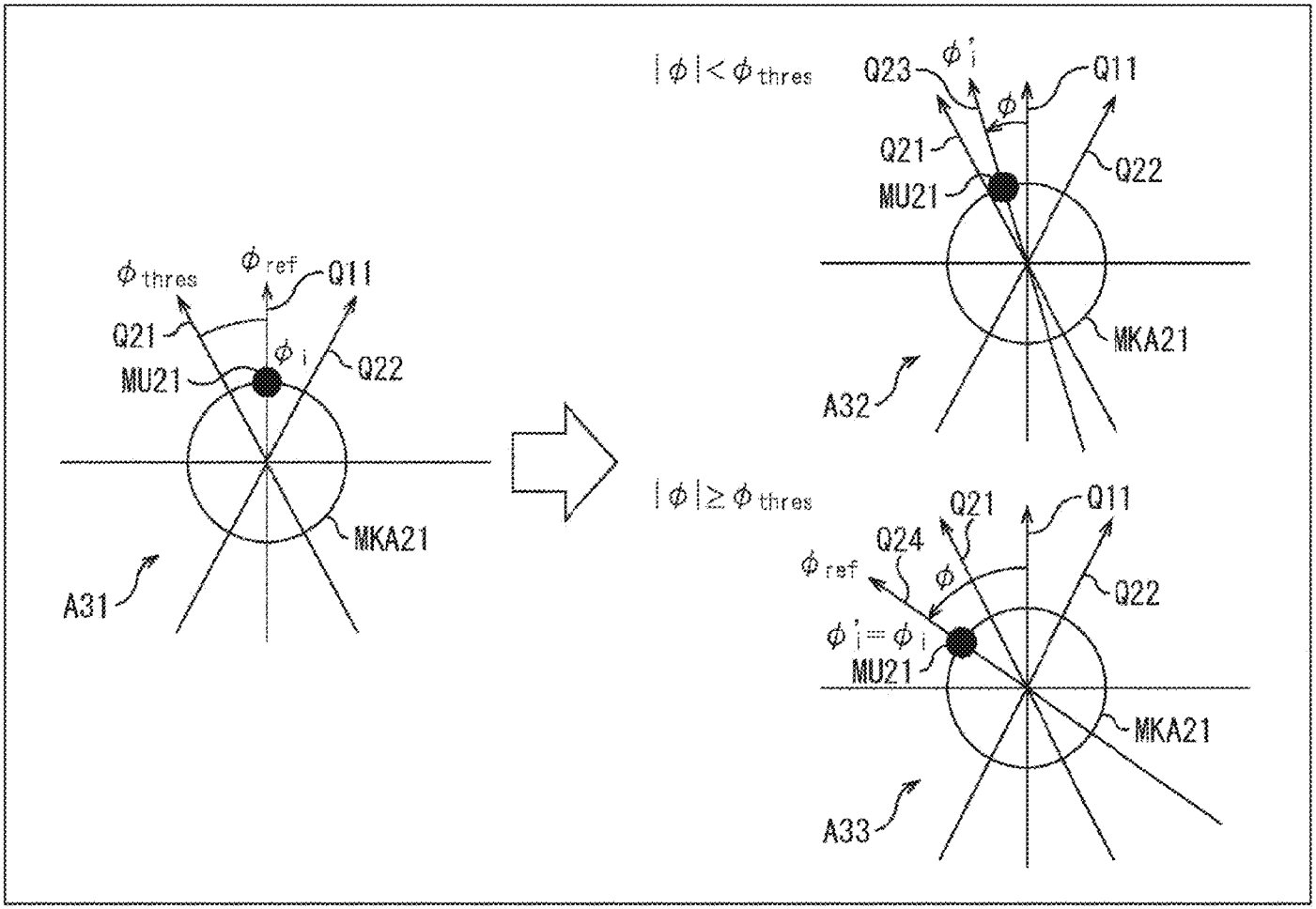
FIG. 5 is a diagram illustrating a blurring correction mode.

Specifically, for example, suppose that attention is paid to an azimuth angle of the microphone unit MU21 configuring the annular microphone array MKA21 serving as the microphone array 31 as shown in FIG. 5. Note that portions in FIG. 5 corresponding to those in FIG. 4 are denoted by the same reference signs, and the descriptions thereof will be omitted as appropriate.

For example, suppose that, as indicated by an arrow A31, a direction indicated by an arrow Q11 is the direction of the azimuth angle $\phi_{ref}$ of the reference direction ($\theta_{ref}$, $\phi_{ref}$), and the direction of the azimuth angle serving as the reference of the microphone unit MU21 is also the direction indicated by the arrow Q11.

In addition, suppose that an angle formed by a straight line in the direction indicated by an arrow Q21 and a straight line in the direction indicated by the arrow Q11 is an angle of a threshold value $\phi_{thres}$, and an angle similarly formed by a straight line in the direction indicated by an arrow Q22 and the straight line in the direction indicated by the arrow Q11 is the angle of the threshold value $\phi_{thres}$.

In this case, if the direction of the azimuth angle of the microphone unit MU21 at the processing target time is a direction between the direction indicated by the arrow Q21 and the direction indicated by the arrow Q22, the rotation amount of the microphone unit MU21 in the azimuth angle direction is sufficiently small, and thus it can be said that the movement of the microphone unit MU21 is due to blurring.

For example, suppose that, as indicated by an arrow A32, the direction of the azimuth angle of the microphone unit MU21 at the processing target time changes by only the angle $\phi$ from the reference direction and becomes the direction indicated by an arrow Q23.

In this case, the direction indicated by the arrow Q23 is the direction between the direction indicated by the arrow Q21 and the direction indicated by the arrow Q22, and the aforementioned expression (5) is satisfied. Therefore, the movement of the microphone unit MU21 in this case is determined as due to blurring, and the correction angle $\beta$ of the azimuth angle of the microphone unit MU21 is obtained by the aforementioned expression (2).

On the other hand, for example, suppose that, as indicated by an arrow A33, the direction of the azimuth angle of the microphone unit MU21 at the processing target time changes by only the angle $\phi$ from the reference direction and becomes the direction indicated by an arrow Q24.

In this case, the direction indicated by the arrow Q24 is not the direction between the direction indicated by the arrow Q21 and the direction indicated by the arrow Q22, and the aforementioned expression (5) is not satisfied. That is, the microphone unit MU21 has moved in the azimuth angle direction by an angle equal to or greater than the threshold value $\phi_{thres}$.

Therefore, the movement of the microphone unit MU21 in this case is determined as due to rotation, and the correction angle $\beta$ of the azimuth angle of the microphone unit MU21 is set to 0. In this case, the azimuth angle $\phi_i'$ of the angle ($\theta_i'$, $\phi_i'$) of the microphone unit MU21 after the direction correction is set to remain as $\phi_i$ in the spatial frequency analysis unit 34.

Moreover, in this case, the azimuth angle $\phi_{ref}$ of the reference direction ($\theta_{ref}$, $\phi_{ref}$) is updated by the aforementioned expression (6). In this example, since the direction of the azimuth angle $\phi_{ref}$ of the reference direction ($\theta_{ref}$, $\phi_{ref}$) before the update is the direction of the azimuth angle of the microphone unit MU21 before the rotational movement, that is, the direction indicated by the arrow Q11, the direction of the azimuth angle of the microphone unit MU21 after the rotational movement, that is, the direction indicated by the arrow Q24 is set as the direction of the azimuth angle $\phi_{ref}$ after the update.

Then, the direction indicated by the arrow Q24 is set as the direction of the new azimuth angle $\phi_{ref}$ at the next processing target time, and the blurring in the azimuth angle direction of the microphone unit MU21 is detected on the basis of the change amount of the azimuth angle of the microphone unit MU21 from the direction indicated by the arrow Q24.

Thus, in the direction correction unit 33, the blurring is independently detected in the azimuth angle direction and the elevation angle direction, and the correction angle of the microphone unit is obtained.

Since the correction angle ($\alpha$, $\beta$) is computed on the basis of the result of the blurring detection in the direction correction unit 33, the spatial frequency spectrum at the time of spatial frequency conversion is corrected in the spatial frequency analysis unit 34 according to the displacement, the angular velocity, the acceleration and the like per unit time of the recording device 21, which are obtained from the image information and the sensor information. This correction of the spatial frequency spectrum is realized by correcting the angle ($\theta_i$, $\phi_i$) of the microphone unit by the correction angle ($\alpha$, $\beta$).

Particularly in the blurring correction mode, only the blurring can be corrected by performing the blurring detection to separate (discriminate) the blurring and the rotation of the recording device 21. This makes it possible to regenerate the sound field more appropriately.

Note that the detection of the blurring of the recording device 21, that is, the blurring of the microphone unit is not limited to the above example and may be performed by any other methods.

Moreover, for example, in a case where the direction correction mode indicated by the correction mode information is the no-correction mode, the direction correction unit 33 sets both the correction angle $\alpha$ of the elevation angle and the correction angle $\beta$ of the azimuth angle, which constitute the correction angle ($\alpha$, $\beta$), to 0 as shown by the following expression (7).

[Expression 7]

$$\begin{cases} \alpha = 0 \\ \beta = 0 \end{cases} \tag{7}$$

In this case, the angle ($\theta_i$, $\phi_i$) of the microphone unit is directly set as the angle ($\theta_i'$, $\phi_i'$) of each microphone unit after the correction. That is, the angle ($\theta_i$, $\phi_i$) of each microphone unit is not corrected in the no-correction mode.

Figure 6:
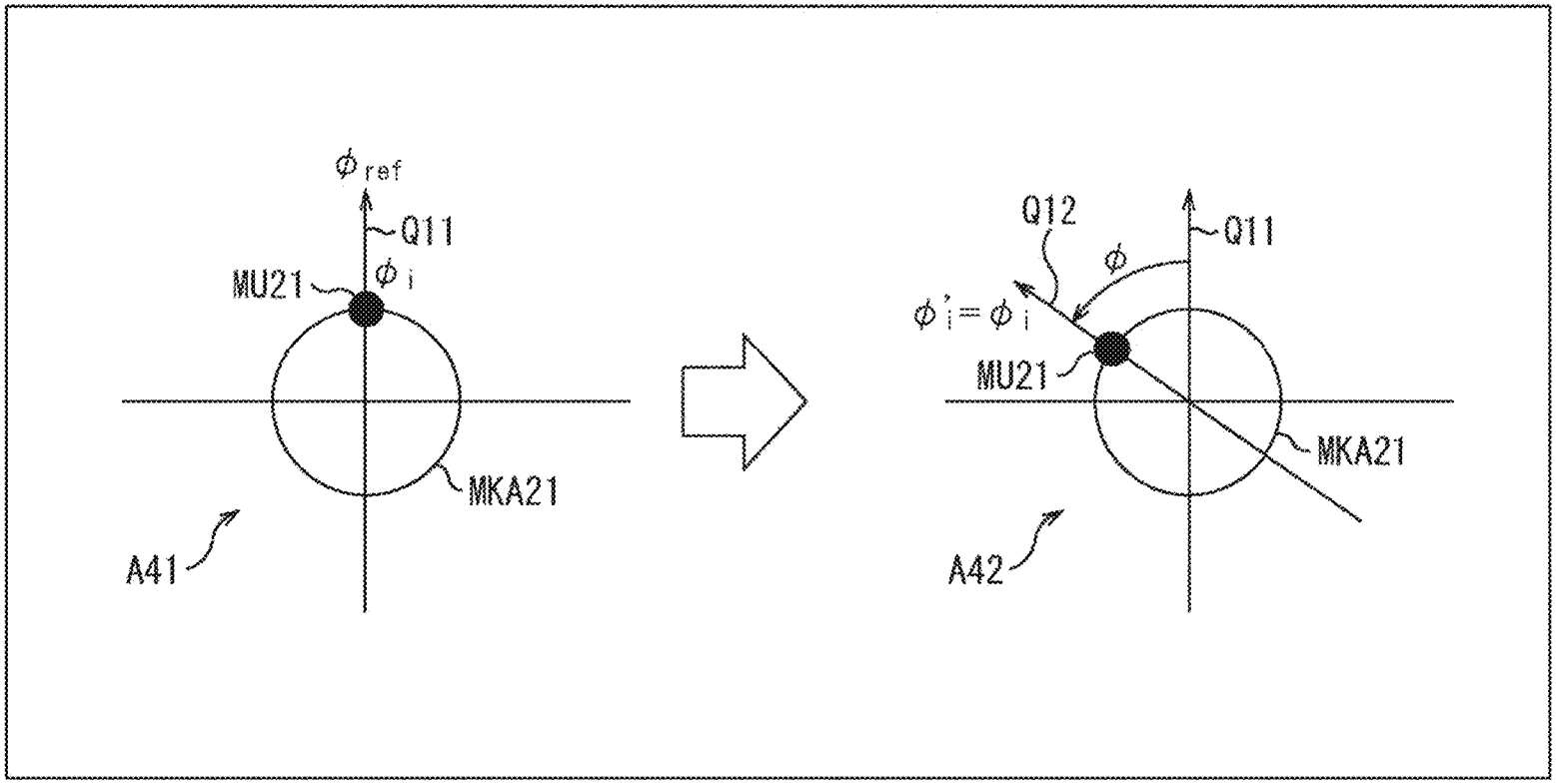
FIG. 6 is a diagram illustrating a no-correction mode.

Specifically, for example, suppose that attention is paid to an azimuth angle of the microphone unit MU21 configuring the annular microphone array MKA21 serving as the microphone array 31 as shown in FIG. 6. Note that portions in FIG. 6 corresponding to those in FIG. 4 are denoted by the same reference signs, and the descriptions thereof will be omitted as appropriate.

For example, suppose that, as indicated by an arrow A41, a direction indicated by an arrow Q11 is the direction of the azimuth angle $\phi_{ref}$ of the reference direction ($\theta_{ref}$, $\phi_{ref}$), and the direction of the azimuth angle serving as the reference of the microphone unit MU21 is also the direction indicated by the arrow Q11.

Suppose that the annular microphone array MKA21 rotates from such a state as indicated by an arrow A42, and the direction of the azimuth angle of the microphone unit MU21 becomes a direction indicated by an arrow Q12 at the processing target time. In this example, the direction of the microphone unit MU21 changes by only an angle $\phi$ in the direction of the azimuth angle.

In the no-correction mode, even in a case where the direction of the microphone unit MU21 changes in this manner, the correction angle ($\alpha$, $\beta$) is set to $\alpha$=0 and $\beta$=0, and the correction of the angle ($\theta_i$, $\phi_i$) of each microphone unit is not performed. That is, the angle ($\theta_i$, $\phi_i$) of the microphone unit MU21 indicated by the microphone disposition information is directly set as the angle ($\theta_i'$, $\phi_i'$) of each microphone unit after the correction.

(Spatial Frequency Analysis Unit)

The spatial frequency analysis unit 34 performs spatial frequency conversion on the time frequency spectrum S (i, $n_{tf}$) supplied from the time frequency analysis unit 32 by using the microphone disposition information and correction angle ($\alpha$, $\beta$) supplied from the direction correction unit 33.

For example, in the spatial frequency conversion, spherical harmonic series expansion is used to convert the time frequency spectrum S (i, $n_{tf}$) into the spatial frequency spectrum $S_{SP}$ ($n_{tf}$, $n_{sf}$). Note that, in the spatial frequency spectrum $S_{SP}$ ($n_{tf}$, $n_{sf}$), $n_{tf}$ denotes a time frequency index, and $n_{sf}$ denotes a spatial frequency index.

In general, a sound field P on a certain sphere can be expressed as shown in the following expression (8).

[Expression 8]

$$P = YWB \tag{8}$$

Note that, in the expression (8), Y denotes a spherical harmonic matrix, W denotes a weighting coefficient according to a sphere radius and the order of the spatial frequency, and B denotes a spatial frequency spectrum. The calculation of such expression (8) corresponds to spatial frequency inverse conversion.

Therefore, the spatial frequency spectrum B can be obtained by calculating the following expression (9). The calculation of this expression (9) corresponds to the spatial frequency conversion.

[Expression 9]

$$B = W^{-1}Y^{+}P \tag{9}$$

Note that $Y^{+}$ in the expression (9) denotes a pseudo inverse matrix of the spherical harmonic matrix Y and is obtained by the following expression (10) with the transposed matrix of the spherical harmonic matrix Y as $Y^T$.

[Expression 10]

$$Y^{+} = (Y^T Y)^{-1} Y^T \tag{10}$$

From the above, it can be seen that the spatial frequency spectrum $S_{SP}$ ($n_{tf}$, $n_{sf}$) is obtained from the following expression (11). The spatial frequency analysis unit 34 calculates the expression (11) to perform the spatial frequency conversion, thereby obtaining the spatial frequency spectrum $S_{SP}$ ($n_{tf}$, $n_{sf}$)

[Expression 11]

$$S_{sp} = (Y_{mic}{}^T Y_{mic})^{-1} Y_{mic}{}^T S \tag{11}$$

Note that $S_{SP}$ in the expression (11) denotes a vector including each spatial frequency spectrum $S_{SP}$ ($n_{tf}$, $n_{sf}$), and a vector $S_{SP}$ is expressed by the following expression (12). Moreover, S in the expression (11) denotes a vector including each time frequency spectrum S (i, $n_{tf}$), and a vector S is expressed by the following expression (13).

Furthermore, $Y_{mic}$ in the expression (11) denotes a spherical harmonic matrix, and the spherical harmonic matrix $Y_{mic}$ is expressed by the following expression (14). Further, $Y_{mic}{}^T$ in the expression (11) denotes a transposed matrix of the spherical harmonic matrix $Y_{mic}$.

Herein, the vector $S_{SP}$, the vector S and the spherical harmonic matrix $Y_{mic}$ in the expression (11) correspond to the spatial frequency spectrum B, the sound field P and the spherical harmonic matrix Y in expression (9). In addition, a weighting coefficient corresponding to the weighting coefficient W shown in the expression (9) is omitted in the expression (11).

[Expression 12]

$$S_{sp} = \begin{bmatrix} S_{sp}(n_{tf}, 0) \\ S_{sp}(n_{tf}, 1) \\ S_{sp}(n_{tf}, 2) \\ \vdots \\ S_{sp}(n_{tf}, N_{sf} - 1) \end{bmatrix} \quad (12)$$

[Expression 13]

$$\begin{bmatrix} S(0, n_{tf}) \\ S(1, n_{tf}) \\ S(2, n_{tf}) \\ \vdots \\ S(I - 1, n_{tf}) \end{bmatrix} \quad (13)$$

[Expression 14]

$$Y_{mic} = \begin{bmatrix} Y_0^0(\theta'_0, \phi'_0) & Y_1^{-1}(\theta'_0, \phi'_0) & \dots & Y_N^M(\theta'_0, \phi'_0) \\ Y_0^0(\theta'_1, \phi'_1) & Y_1^{-1}(\theta'_1, \phi'_1) & \dots & Y_N^M(\theta'_1, \phi'_1) \\ \vdots & \vdots & \ddots & \vdots \\ Y_0^0(\theta'_{I-1}, \phi'_{I-1}) & Y_1^{-1}(\theta'_{I-1}, \phi'_{I-1}) & \dots & Y_N^M(\theta'_{I-1}, \phi'_{I-1}) \end{bmatrix} \quad (14)$$

Moreover, $N_{sf}$ in the expression (12) denotes a value determined by the maximum value of the order of the spherical harmonics described later and is a spatial frequency index $n_{sf}=0, 1, \dots, N_{sf}-1$.

Furthermore, $Y_n^m(\theta, \phi)$ in the expression (14) is spherical harmonics expressed by the following expression (15).

[Expression 15]

$$Y_n^m(\theta, \phi) = \sqrt{\frac{(2n+1)}{4\pi}\frac{(n-m)!}{(n+m)!}}\, P_n^m(\cos\theta)e^{j\omega\phi} \quad (15)$$

In the expression (15), n and m denote the orders of the spherical harmonics $Y_n^m(\theta, \phi)$, j denotes a pure imaginary number, and ω denotes an angular frequency. In addition, the maximum value of the order n, that is, the maximum order is n=N, and $N_{sf}$ in the expression (12) is $N_{sf}=(N+1)^2$.

Further, $\theta_i'$ and $\phi_i'$ in the spherical harmonics of the expression (14) are the elevation angle and the azimuth angle after the correction by the correction angle (α, β) of the elevation angle $\theta_i$ and azimuth angle $\phi_i$, which constitute the angle $(\theta_i, \phi_i)$ of the microphone unit indicated by the microphone disposition information. The angle $(\theta_i', \phi_i')$ of the microphone unit after the direction correction is an angle expressed by the following expression (16).

[Expression 16]

$$\begin{cases} \theta'_i = \alpha + \theta_i \\ \phi'_i = \beta + \phi_i \end{cases} \quad (16)$$

As described above, in the spatial frequency analysis unit 34, the angle indicating the direction of the microphone array 31, more specifically, the angle $(\theta_i, \phi_i)$ of each microphone unit is corrected by the correction angle (α, β) at a time of the spatial frequency conversion.

By correcting the angle $(\theta_i, \phi_i)$, which indicates the direction of each microphone unit of the microphone array 31 in the spherical harmonics used for the spatial frequency conversion, by the correction angle (α, β), the spatial frequency spectrum $S_{SP}(n_{tf}, n_{sf})$ is appropriately corrected. That is, the spatial frequency spectrum $S_{SP}(n_{tf}, n_{sf})$ for regenerating the sound field, in which the rotation and blurring of the microphone array 31 have been corrected, can be obtained as appropriate.

When the spatial frequency spectrum $S_{SP}(n_{tf}, n_{sf})$ is obtained by the above calculations, the spatial frequency analysis unit 34 supplies the spatial frequency spectrum $S_{SP}(n_{tf}, n_{sf})$ to the spatial frequency synthesizing unit 42 through the communication unit 35 and the communication unit 41.

Note that a method of obtaining a spatial frequency spectrum by spatial frequency conversion is described in detail in, for example, "Jerome Daniel, RozennNicol, SebastienMoreau, "Further Investigations of High Order Ambisonics and Wavefield Synthesis for Holophonic Sound Imaging," AES 114th Convention, Amsterdam, Netherlands, 2003" and the like.

(Spatial Frequency Synthesizing Unit)

The spatial frequency synthesizing unit 42 uses the spherical harmonic matrix by an angle indicating the direction of each speaker configuring the speaker array 44 to perform the spatial frequency inverse conversion on the spatial frequency spectrum $S_{SP}(n_{tf}, n_{sf})$ obtained in the spatial frequency analysis unit 34 and obtains the time frequency spectrum. That is, the spatial frequency inverse conversion is performed as spatial frequency synthesis.

Note that each speaker configuring the speaker array 44 is also referred to as a speaker unit hereinafter. Herein, the number of speaker units configuring the speaker array 44 is set as the number of speaker units L, and a speaker unit index indicating each speaker unit is set as l. In this case, the speaker unit index l=0, 1, . . . , L−1.

Suppose that the speaker disposition information currently supplied from outside to the spatial frequency synthesizing unit 42 is an angle $(\xi_l, \psi_1)$ indicating the direction of each speaker unit indicated by the speaker unit index l.

Herein, $\xi_l$ and $\psi_l$ constituting the angle $(\xi_l, \psi_l)$ of the speaker unit are angles which indicate an elevation angle and an azimuth angle of the speaker unit, corresponding to the aforementioned elevation angle $\theta_i$ and azimuth angle $\phi_i$, respectively, and are angles from a predetermined reference direction.

The spatial frequency synthesizing unit 42 calculates the following expression (17) on the basis of the spherical harmonics $Y_n^m(\xi_l, \psi_l)$ obtained for the angle $(\xi_l, \psi_l)$ indicating the direction of the speaker unit indicated by the speaker unit index l, and the spatial frequency spectrum $S_{SP}(n_{tf}, n_{sf})$ to perform the spatial frequency inverse conversion and obtains a time frequency spectrum D (l, $n_{tf}$)

[Expression 17]

$$D = Y_{SP}S_{SP} \quad (17)$$

Note that D in the expression (17) denotes a vector including each time frequency spectrum D (1, $n_{tf}$), and a vector D is expressed by the following expression (18). Moreover, $S_{SP}$ in the expression (17) denotes a vector including each spatial frequency spectrum $S_{SP}(n_{tf}, n_{sf})$, and the vector $S_{SP}$ is expressed by the following expression (19).

Furthermore, $Y_{SP}$ in the expression (17) denotes the spherical harmonic matrix including each spherical harmonic $Y_n^m(\xi_l, \psi_l)$, and the spherical harmonic matrix $Y_{SP}$ is expressed by the following expression (20).

[Expression 18]

$$D = \begin{bmatrix} D(0, n_{tf}) \\ D(1, n_{tf}) \\ D(2, n_{tf}) \\ \vdots \\ D(L-1, n_{tf}) \end{bmatrix} \tag{18}$$

[Expression 19]

$$S_{sp} = \begin{bmatrix} S_{sp}(n_{tf}, 0) \\ S_{sp}(n_{tf}, 1) \\ S_{sp}(n_{tf}, 2) \\ \vdots \\ S_{sp}(n_{tf}, N_{sf}-1) \end{bmatrix} \tag{19}$$

[Expression 20]

$$Y_{sp} = \begin{bmatrix} Y_0^0(\xi_0, \psi_0) & Y_1^{-1}(\xi_0, \psi_0) & \dots & Y_N^N(\xi_0, \psi_0) \\ Y_0^0(\xi_1, \psi_1) & Y_1^{-1}(\xi_1, \psi_1) & \dots & Y_N^N(\xi_1, \psi_1) \\ \vdots & \vdots & \ddots & \vdots \\ Y_0^0(\xi_{L-1}, \psi_{L-1}) & Y_1^{-1}(\xi_{L-1}, \psi_{L-1}) & \dots & Y_N^N(\xi_{L-1}, \psi_{L-1}) \end{bmatrix} \tag{20}$$

The spatial frequency synthesizing unit 42 supplies the time frequency spectrum D (1, $n_{tf}$) thus obtained to the time frequency synthesizing unit 43.

(Time Frequency Synthesizing Unit)

By calculating the following expression (21), the time frequency synthesizing unit 43 performs time frequency synthesis using inverse discrete Fourier transform (IDFT) on the time frequency spectrum D (1, $n_{tf}$) supplied from the spatial frequency synthesizing unit 42 and computes a speaker driving signal d (1, $n_d$) which is a time signal.

[Expression 21]

$$d(l, n_d) = \frac{1}{M_{dt}} \sum_{n_{tf}=0}^{M_{dt}-1} D(l, n_{tf}) e^{j\frac{2\pi n_d n_{tf}}{M_{dt}}} \tag{21}$$

Note that, in the expression (21), $n_d$ denotes a time index, and $M_{dt}$ denotes the number of samples of the IDFT. Also in the expression (21), j denotes a pure imaginary number.

The time frequency synthesizing unit 43 supplies the speaker driving signal d (1, $n_d$) thus obtained to each speaker unit configuring the speaker array 44 to reproduce the sound.

<Description of Sound Field Regeneration Processing>

Next, the operation of the recording sound field direction controller 11 will be described. When instructed to record and regenerate the sound field, the recording sound field direction controller 11 performs sound field regeneration processing to regenerate, in the reproduction space, the sound field in the sound pickup space. Hereinafter, the sound field regeneration processing by the recording sound field direction controller 11 will be described with reference to a flowchart in FIG. 7.

In step S11, the microphone array 31 picks up the sound of the contents in the sound pickup space and supplies the multichannel sound pickup signal s (i, $n_t$) obtained as a result to the time frequency analysis unit 32.

In step S12, the time frequency analysis unit 32 analyzes the time frequency information of the sound pickup signal s (i, $n_t$) supplied from the microphone array 31.

Specifically, the time frequency analysis unit 32 performs the time frequency conversion on the sound pickup signal s (i, $n_t$) and supplies the time frequency spectrum S (i, $n_{tf}$) obtained as a result to the spatial frequency analysis unit 34. For example, the aforementioned calculation of the expression (1) is performed in step S12.

In step S13, the direction correction unit 33 determines whether or not the rotation blurring correction mode is in effect. That is, the direction correction unit 33 acquires the correction mode information from outside and determines whether or not the direction correction mode indicated by the acquired correction mode information is the rotation blurring correction mode.

In a case where the rotation blurring correction mode is determined in step S13, the direction correction unit 33 computes the correction angle (α, β) in step S14.

Specifically, the direction correction unit 33 acquires at least one of the image information and the sensor information and obtains the rotation angle (θ, ϕ) of the microphone array 31 on the basis of the acquired information. Then, the direction correction unit 33 sets the obtained rotation angle (θ, ϕ) directly as the correction angle (α, β). Moreover, the direction correction unit 33 acquires the microphone disposition information including the angle ($\theta_i$, $\phi_i$) of each microphone unit and supplies the acquired microphone disposition information and the obtained correction angle (α, β) to the spatial frequency analysis unit 34, and the processing proceeds to step S19.

On the other hand, in a case where the rotation blurring correction is not determined in step S13, the direction correction unit 33 determines in step S15 whether or not the direction correction mode indicated by the correction mode information is the blurring correction mode.

In a case where the blurring correction mode is determined in step S15, the direction correction unit 33 acquires at least one of the image information and the sensor information and detects the blurring of the recording device 21, that is, the microphone array 31 on the basis of the acquired information in step S16.

For example, the direction correction unit 33 obtains the rotation angle (θ, ϕ) per unit time on the basis of at least one of the image information and the sensor information and detects the blurring for both the elevation angle and the azimuth angle from the aforementioned expressions (3) and (5).

In step S17, the direction correction unit 33 computes the correction angles (α, β) according to the results of the blurring detection in step S16.

Specifically, the direction correction unit 33 sets the elevation angle θ of the rotation angle (θ, ϕ) directly as the correction angle c of the elevation angle of the correction angle (α, β) in a case where the expression (3) is met and the blurring in the elevation angle direction is detected, and sets the correction angle α to 0 in a case where the blurring in the elevation angle direction is not detected.

Moreover, the direction correction unit 33 sets the azimuth angle of the rotation angle (θ, ϕ) directly as the correction angle β of the azimuth angle of the correction angle (α, β) in a case where the expression (5) is met and the blurring in the azimuth angle direction is detected, and sets the correction angle β to 0 in a case where the blurring in the azimuth angle direction is not detected.

In step S18, the direction correction unit 33 updates the reference direction ($\theta_{ref}$, $t_{ref}$) according to the results of the blurring detection.

That is, the direction correction unit 33 updates the elevation angle $\phi_{ref}$ by the aforementioned expression (4) in a case where the blurring in the elevation angle direction is detected, and does not update the elevation angle $\theta_{ref}$ in a case where the blurring in the elevation angle direction is not detected. Similarly, the direction correction unit 33 updates the azimuth angle $\phi_{ref}$ by the aforementioned expression (6) in a case where the blurring in the azimuth angle direction is detected, and does not update the azimuth angle $\phi_{ref}$ in a case where the blurring in the azimuth angle direction is not detected.

When the reference direction ($\theta_{ref}$, $t_{ref}$) is thus updated, the direction correction unit 33 acquires the microphone disposition information and supplies the acquired microphone disposition information and the obtained correction angle ($\alpha$, $\beta$) to the spatial frequency analysis unit 34, and the processing proceeds to step S19.

Furthermore, in a case where the blurring correction mode is not determined in step S15, that is, in a case where the direction correction mode indicated by the correction mode information is the no-correction mode, the direction correction unit 33 sets each angle of the correction angle ($\alpha$, $\beta$) to 0 as shown in the expression (7).

Then, the direction correction unit 33 acquires the microphone disposition information and supplies the acquired microphone disposition information and the correction angle ($\alpha$, $\beta$) to the spatial frequency analysis unit 34, and the processing proceeds to step S19.

In a case where the processing of step S14 or step S18 is performed or the blurring correction mode is not determined in step S15, the spatial frequency analysis unit 34 performs the spatial frequency conversion in step S19.

Specifically, the spatial frequency analysis unit 34 performs the spatial frequency conversion by calculating the aforementioned expression (11) on the basis of the microphone disposition information and correction angle ($\alpha$, $\beta$) supplied from the direction correction unit 33 and the time frequency spectrum S (i, $n_{tf}$) supplied from the time frequency analysis unit 32.

The spatial frequency analysis unit 34 supplies the spatial frequency spectrum $S_{SP}$ ($n_{tf}$, $n_{sf}$) obtained by the spatial frequency conversion to the communication unit 35.

In step S20, the communication unit 35 transmits the spatial frequency spectrum $S_{SP}$ ($n_{tf}$, $n_{sf}$) supplied from the spatial frequency analysis unit 34.

In step S21, the communication unit 41 receives the spatial frequency spectrum $S_{SP}$ ($n_{tf}$, $n_{sf}$) transmitted by the communication unit 35 and supplies the same to the spatial frequency synthesizing unit 42.

In step S22, the spatial frequency synthesizing unit 42 calculates the aforementioned expression (17) on the basis of the spatial frequency spectrum $S_{SP}$ ($n_{tf}$, $n_{sf}$) supplied from the communication unit 41 and the speaker disposition information supplied from outside and performs the spatial frequency inverse conversion. The spatial frequency synthesizing unit 42 supplies the time frequency spectrum D (1, $n_{tf}$) obtained by the spatial frequency inverse conversion to the time frequency synthesizing unit 43.

In step S23, the time frequency synthesizing unit 43 calculates the aforementioned expression (21) to perform the time frequency synthesis on the time frequency spectrum D (1, $n_{tf}$) supplied from the spatial frequency synthesizing unit 42 and computes the speaker driving signal d (1, $n_d$).

The time frequency synthesizing unit 43 supplies the obtained speaker driving signal d (1, $n_d$) to each speaker unit configuring the speaker array 44.

In step S24, the speaker array 44 reproduces the sound on the basis of the speaker driving signal d (1, $n_d$) supplied from the time frequency synthesizing unit 43. As a result, the sound of the contents, that is, the sound field in the sound pickup space is regenerated.

When the sound field in the sound pickup space is regenerated in the reproduction space in this manner, the sound field regeneration processing ends.

As described above, the recording sound field direction controller 11 computes the correction angle ($\alpha$, $\beta$) according to the direction correction mode and computes the spatial frequency spectrum $S_{SP}$ ($n_{tf}$, $n_{sf}$) by using the angle of each microphone unit, which has been corrected on the basis of the correction angle ($\alpha$, $\beta$) at the time of the spatial frequency conversion.

In this manner, even in a case where the microphone array 31 is rotated or blurred at the time of recording the sound field, the direction of the recording sound field can be fixed in a certain direction as necessary, and the sound field can be regenerated more appropriately.

Second Embodiment

<Configuration Example of Recording Sound Field Direction Controller>

Note that an example, in which the direction of the recording sound field, that is, the rotation and the blurring is corrected by correcting the angle of the microphone unit at the time of the spatial frequency conversion, has been described above. However, the present technology is not limited to this, and the direction of the recording sound field may be corrected by correcting the angle (direction) of the speaker unit at the time of the spatial frequency inverse conversion.

Figure 8:
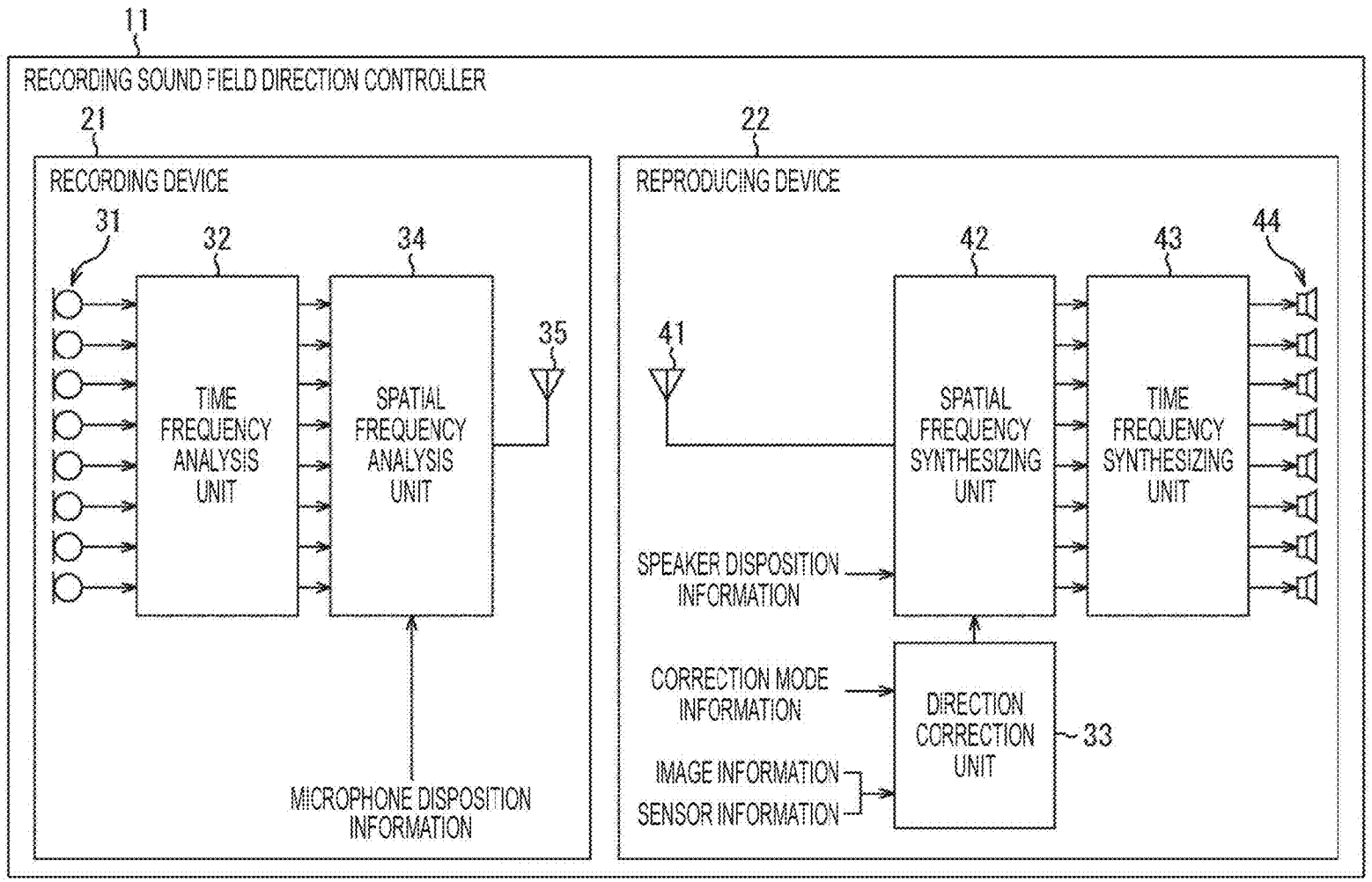
FIG. 8 is a diagram showing a configuration example of a recording sound field direction controller.

In such a case, a recording sound field direction controller 11 is configured, for example, as shown in FIG. 8. Note that portions in FIG. 8 corresponding to those in FIG. 2 are denoted by the same reference signs, and the descriptions thereof will be omitted as appropriate.

The configuration of the recording sound field direction controller 11 shown in FIG. 8 is different from the configuration of the recording sound field direction controller 11 shown in FIG. 2 in that a direction correction unit 33 is provided in a reproducing device 22. For other parts, the recording sound field direction controller shown in FIG. 8 has the same configuration as the recording sound field direction controller 11 shown in FIG. 2.

That is, in the recording sound field direction controller 11 shown in FIG. 8, a recording device 21 has a microphone array 31, a time frequency analysis unit 32, a spatial frequency analysis unit 34 and a communication unit 35. In addition, the reproducing device 22 has a communication unit 41, the direction correction unit 33, a spatial frequency synthesizing unit 42, a time frequency synthesizing unit 43 and a speaker array 44.

In this example, similarly to the example shown in FIG. 2, the direction correction unit 33 acquires correction mode information, image information and sensor information to compute a correction angle ($\alpha$, $\beta$) and supplies the obtained correction angle ($\alpha$, $\beta$) to the spatial frequency synthesizing unit 42.

In this case, the correction angle ($\alpha$, $\beta$) is an angle for correcting an angle ($\xi_l$, $\psi_l$) indicating the direction of each speaker unit indicated by speaker disposition information.

Note that the image information and the sensor information may be transmitted/received between the recording device 21 and the reproducing device 22 by the communication unit 35 and the communication unit 41 and supplied to the direction correction unit 33, or may be acquired by the direction correction unit 33 with other methods.

In a case where the correction of the angle (direction) is performed with the correction angle ($\alpha$, $\beta$) in the reproducing device 22 in this manner, the spatial frequency analysis unit 34 acquires microphone disposition information from outside. Then, the spatial frequency analysis unit 34 performs spatial frequency conversion by calculating the aforementioned expression (11) on the basis of the acquired microphone disposition information and a time frequency spectrum S (i, $n_{tf}$) supplied from the time frequency analysis unit 32.

However, in this case, the spatial frequency analysis unit 34 performs calculation of the expression (11) by using the spherical harmonic matrix $Y_{mic}$ shown in the following expression (22), which is obtained from the angle ($\theta_i$, $\phi_i$) of the microphone unit indicated by the microphone disposition information.

[Expression 22]

$$Y_{mic} = \begin{bmatrix} Y_0^0(\theta_0, \phi_0) & Y_1^{-1}(\theta_0, \phi_0) & \dots & Y_N^M(\theta_0, \phi_0) \\ Y_0^0(\theta_1, \phi_1) & Y_1^{-1}(\theta_1, \phi_1) & \dots & Y_N^M(\theta_1, \phi_1) \\ \vdots & \vdots & \ddots & \vdots \\ Y_0^0(\theta_{l-1}, \phi_{l-1}) & Y_1^{-1}(\theta_{l-1}, \phi_{l-1}) & \dots & Y_N^M(\theta_{l-1}, \phi_{l-1}) \end{bmatrix} \tag{22}$$

That is, in the spatial frequency analysis unit 34, the calculation of the spatial frequency conversion is performed without performing the correction of the angle ($\theta_i$, $\phi_i$) of the microphone unit.

Moreover, in the spatial frequency synthesizing unit 42, the calculation of the following expression (23) is performed on the basis of the correction angle ($\alpha$, $\beta$) supplied from the direction correction unit 33, and an angle ($\xi_l$, $\psi_l$) indicating the direction of each speaker unit indicated by the speaker disposition information is corrected.

[Expression 23]

$$\begin{cases} \xi_l' = \alpha + \xi_l \\ \psi_l' = \beta + \psi_l \end{cases} \tag{23}$$

Note that $\xi_l'$ and $\psi_l'$ in the expression (23) are angles which are obtained by correcting the angle ($\xi_l$, $\psi_l$) with the correction angle ($\alpha$, $\beta$) and indicate the direction of each speaker unit after the direction correction. That is, the elevation angle $\xi_l'$ is obtained by correcting the elevation angle $\xi_l$ with the correction angle $\alpha$, and the azimuth angle $\psi_l'$ is obtained by correcting the azimuth angle $\psi_l$ with the correction angle $\beta$.

When the angles (51', $\psi_l'$) of the speaker units after the direction correction are obtained in this manner, the spatial frequency synthesizing unit 42 calculates the aforementioned expression (17) by using the spherical harmonic matrix $Y_{SP}$ shown in the following expression (24), which is obtained from these angles ($\xi_l'$, $\phi_l'$), and performs spatial frequency inverse conversion. That is, the spatial frequency inverse conversion is performed by using the spherical harmonic matrix $Y_{SP}$ including the spherical harmonics obtained by the angles ($\xi_l'$, $\psi_l'$) of the speaker units after the direction correction.

[Expression 24]

$$Y_{sp} = \begin{bmatrix} Y_0^0(\xi_0', \psi_0') & Y_1^{-1}(\xi_0', \psi_0') & \dots & Y_N^N(\xi_0', \psi_0') \\ Y_0^0(\xi_1', \psi_1') & Y_1^{-1}(\xi_1', \psi_1') & \dots & Y_N^N(\xi_1', \psi_1') \\ \vdots & \vdots & \ddots & \vdots \\ Y_0^0(\xi_{L-1}', \psi_{L-1}') & Y_1^{-1}(\xi_{L-1}', \psi_{L-1}') & \dots & Y_N^N(\xi_{L-1}', \psi_{L-1}') \end{bmatrix} \tag{24}$$

As described above, in the spatial frequency synthesizing unit 42, the angle indicating the direction of the speaker array 44, more specifically, the angle ($\xi_l$, $\psi_l$) of each speaker unit is corrected with the correction angle ($\alpha$, $\beta$) at the time of the spatial frequency inverse conversion.

By correcting the angle ($\xi_l$, $\psi_l$) indicating the direction of each speaker unit of the speaker array 44 in the spherical harmonics used in the spatial frequency inverse conversion with the correction angle ($\alpha$, $\beta$), the spatial frequency spectrum $S_{SP}$ ($n_{tf}$, $n_{sf}$) is appropriately corrected. That is, the time frequency spectrum D (1, $n_{tf}$) for regenerating the sound field, in which the rotation and the blurring of the microphone array 31 have been corrected as appropriate, can be obtained by the spatial frequency inverse conversion.

As described above, in the recording sound field direction controller 11 shown in FIG. 8, the angle (direction) of the speaker unit, not the microphone unit, is corrected to regenerate the sound field.

<Description of Sound Field Regeneration Processing>

Figure 9:
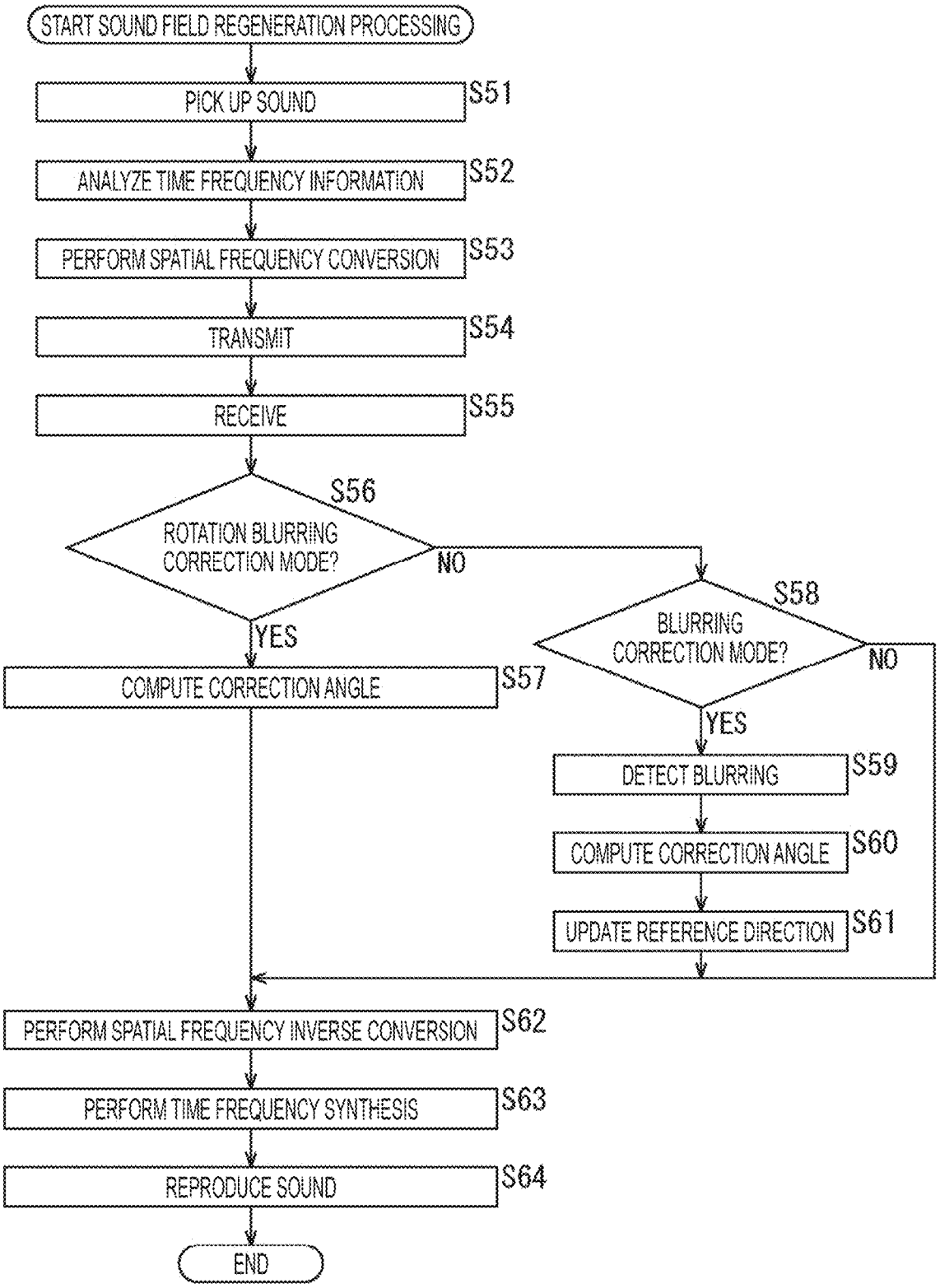
FIG. 9 is a flowchart illustrating sound field regeneration processing.

Next, the sound field regeneration processing performed by the recording sound field direction controller 11 shown in FIG. 8 will be described with reference to a flowchart in FIG. 9.

Figure 7:
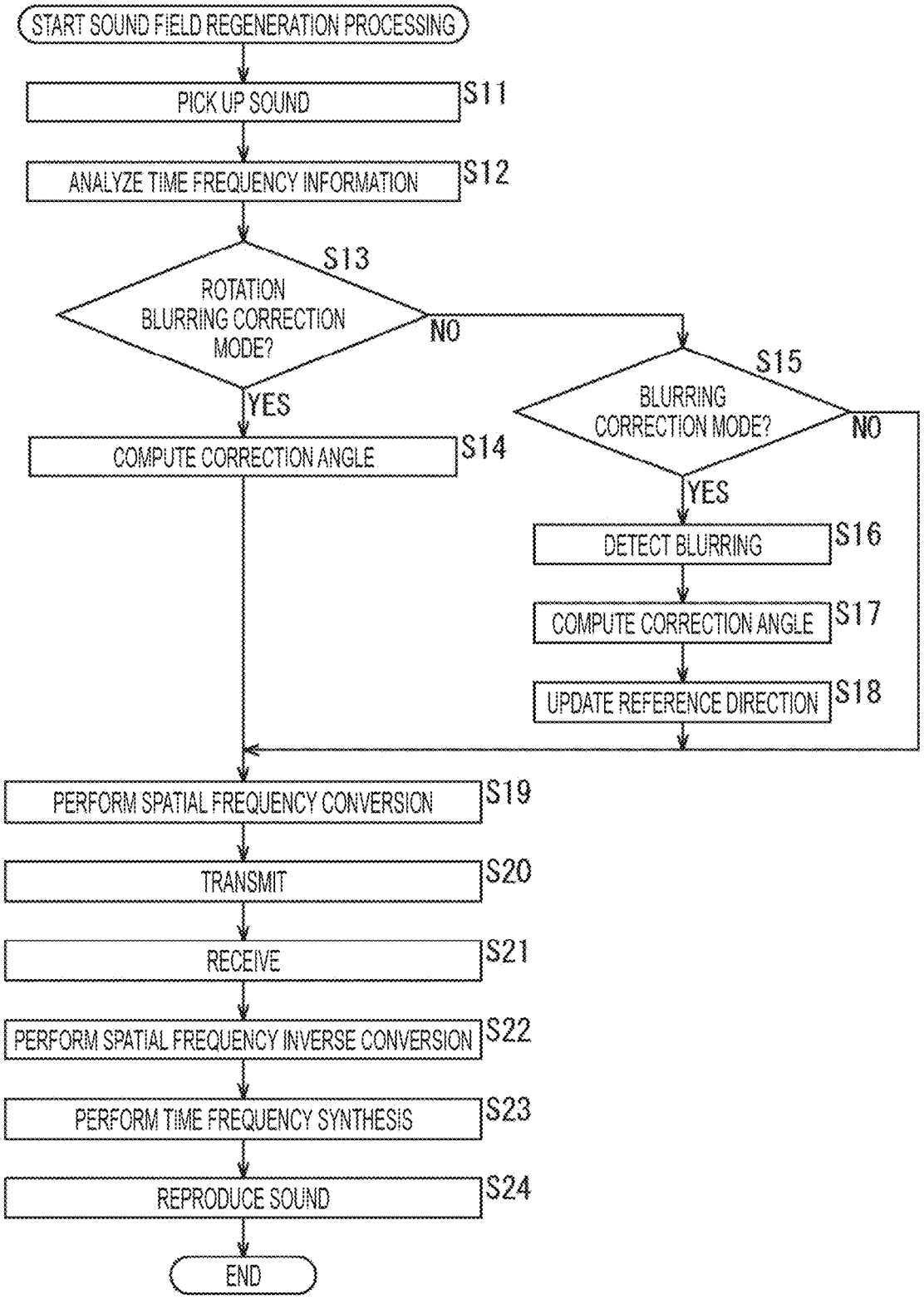
FIG. 7 is a flowchart illustrating sound field regeneration processing.

Note that processings in steps S51 and S52 are similar to the processings in steps S11 and S12 in FIG. 7 so that descriptions thereof will be omitted.

In step S53, the spatial frequency analysis unit 34 performs the spatial frequency conversion and supplies the spatial frequency spectrum $S_{SP}$ ($n_{tf}$, $n_{sf}$) obtained as a result to the communication unit 35.

Specifically, the spatial frequency analysis unit 34 acquires the microphone disposition information and calculates the expression (11) on the basis of the spherical harmonic matrix $Y_{mic}$ shown in the expression (22) obtained from that microphone disposition information, and the time frequency spectrum S (i, $n_{tf}$) supplied from the time frequency analysis unit 32 to perform the spatial frequency conversion.

When the spatial frequency spectrum $S_{SP}$ ($n_{tf}$, $n_{sf}$) is obtained by the spatial frequency conversion, the processings in steps S54 and S55 are performed thereafter, and the spatial frequency spectrum $S_{SP}$ ($n_{tf}$, $n_{sf}$) is supplied to the spatial frequency synthesizing unit 42. Note that processings in steps S54 and S55 are similar to the processings in steps S20 and S21 in FIG. 7 so that descriptions thereof will be omitted.

Moreover, when the processing in step S55 is performed, processings in steps S56 to S61 are performed thereafter, and the correction angle ($\alpha$, $\beta$) for correcting the angle ($\xi_l$, $\psi_l$) of each speaker unit of the speaker array 44 is computed. Note that these processings in steps S56 to S61 are similar to the processings in steps S13 to S18 in FIG. 7 so that descriptions thereof will be omitted.

When the correction angle ($\alpha$, $\beta$) is obtained by performing the processings in steps S56 to S61, the direction correction unit 33 supplies the obtained correction angle ($\alpha$, β) to the spatial frequency synthesizing unit 42, and the processing proceeds to step S62 thereafter.

In step S62, the spatial frequency synthesizing unit 42 acquires the speaker disposition information and performs the spatial frequency inverse conversion on the basis of the acquired speaker disposition information, the correction angle (α, β) supplied from the direction correction unit 33, and the spatial frequency spectrum $S_{SP}$ ($n_{tf}$, $n_{sf}$) supplied from the communication unit 41.

Specifically, the spatial frequency synthesizing unit 42 calculates the expression (23) on the basis of the speaker disposition information and the correction angle (α, β) and obtains the spherical harmonic matrix $Y_{SP}$ shown in the expression (24). Moreover, the spatial frequency synthesizing unit 42 calculates the expression (17) on the basis of the obtained spherical harmonic matrix $Y_{SP}$ and the spatial frequency spectrum $S_{SP}$ ($n_{tf}$, $n_{sf}$) and computes the time frequency spectrum D (1, $n_{tf}$)

The spatial frequency synthesizing unit 42 supplies the time frequency spectrum D (1, $n_{tf}$) obtained by the spatial frequency inverse conversion to the time frequency synthesizing unit 43.

Thereupon, the processings in steps S63 and S64 are performed thereafter, and the sound field regeneration processing ends. These processings are similar to the processings in steps S23 and S24 in FIG. 7 so that descriptions thereof will be omitted.

As described above, the recording sound field direction controller 11 computes the correction angle (α, β) according to the direction correction mode and computes the time frequency spectrum D (1, $n_{tf}$) by using the angle of each speaker unit, which has been corrected on the basis of the correction angle (α, β) at the time of the spatial frequency inverse conversion.

In this manner, even in a case where the microphone array 31 is rotated or blurred at the time of recording the sound field, the direction of the recording sound field can be fixed in a certain direction as necessary, and the sound field can be regenerated more appropriately.

Note that, although an annular microphone array and a spherical microphone array have been described above as an example of the microphone array 31, a linear microphone array may also be used as the microphone array 31. Even in such a case, the sound field can be regenerated by processings similar to the processings described above.

Moreover, the speaker array 44 is also not limited to an annular speaker array or a spherical speaker array and may be any one such as a linear speaker array.

Incidentally, the series of processings described above can be executed by hardware or can be executed by software. In a case where the series of processings is executed by the software, a program configuring the software is installed in a computer. Herein, the computer includes a computer incorporated into dedicated hardware and, for example, a general-purpose computer capable of executing various functions by being installed with various programs.

Figure 10:
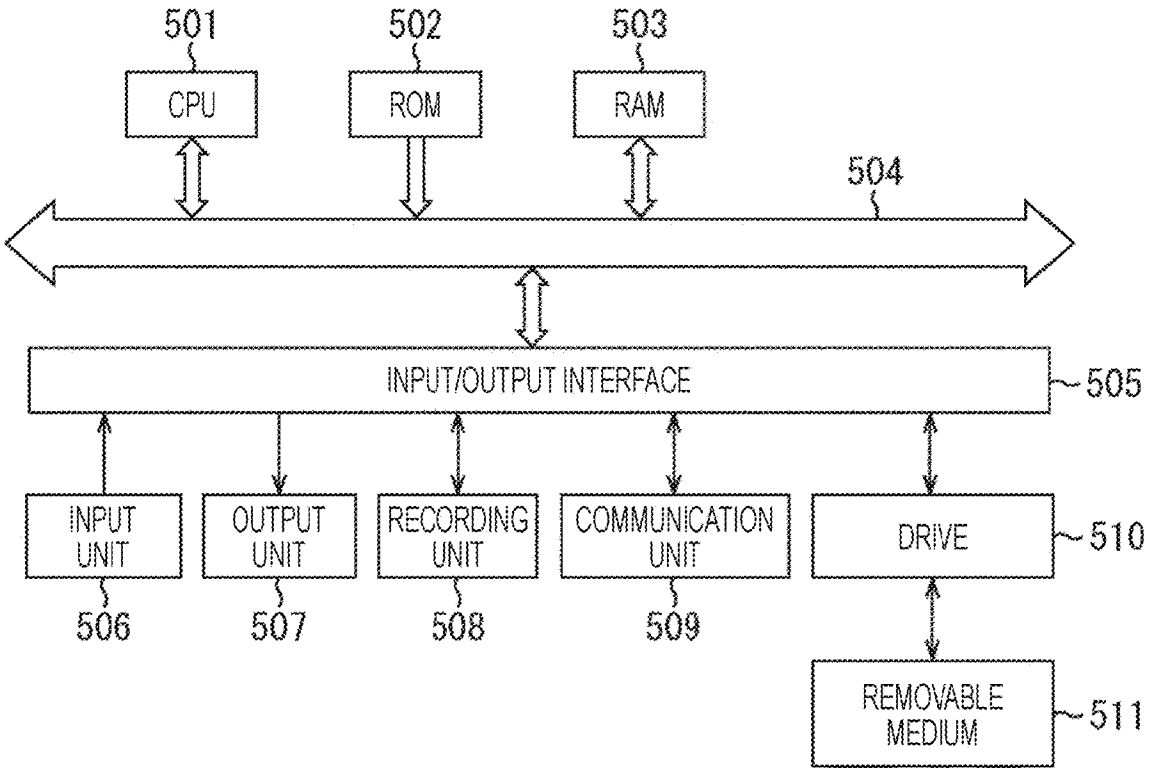
FIG. 10 is a diagram showing a configuration example of a computer.

FIG. 10 is a block diagram showing a configuration example of hardware of a computer which executes the aforementioned series of processings by a program.

In the computer, a central processing unit (CPU) 501, a read only memory (ROM) 502, and a random access memory (RAM) 503 are connected to each other by a bus 504.

The bus 504 is further connected to an input/output interface 505. To the input/output interface 505, an input unit 506, an output unit 507, a recording unit 508, a communication unit 509, and a drive 510 are connected.

The input unit 506 includes a keyboard, a mouse, a microphone, an imaging element and the like. The output unit 507 includes a display, a speaker and the like. The recording unit 508 includes a hard disk, a nonvolatile memory and the like. The communication unit 509 includes a network interface and the like. The drive 510 drives a removable medium 511 such as a magnetic disk, an optical disk, a magneto-optical disk, or a semiconductor memory.

In the computer configured as described above, the CPU 501 loads, for example, a program recorded in the recording unit 508 into the RAM 503 via the input/output interface 505 and the bus 504 and executes the program, thereby performing the aforementioned series of processings.

The program executed by the computer (CPU 501) can be, for example, recorded in the removable medium 511 as a package medium or the like to be provided. Moreover, the program can be provided via a wired or wireless transmission medium such as a local area network, the Internet, digital satellite broadcasting or the like.

In the computer, the program can be installed in the recording unit 508 via the input/output interface 505 by attaching the removable medium 511 to the drive 510. Furthermore, the program can be received by the communication unit 509 via the wired or wireless transmission medium and installed in the recording unit 508. In addition, the program can be installed in the ROM 502 or the recording unit 508 in advance.

Note that the program executed by the computer may be a program in which the processings are performed in time series according to the order described in the present description, or may be a program in which the processings are performed in parallel or at necessary timings such as when a call is made.

Moreover, the embodiments of the present technology are not limited to the above embodiments, and various modifications can be made in a scope without departing from the gist of the present technology.

For example, the present technology can adopt a configuration of cloud computing in which one function is shared and collaboratively processed by a plurality of devices via a network.

Furthermore, each step described in the aforementioned flowcharts can be executed by one device or can also be shared and executed by a plurality of devices.

Further, in a case where a plurality of processings are included in one step, the plurality of processings included in the one step can be executed by one device or can also be shared and executed by a plurality of devices.

In addition, the effects described in the present description are merely examples and are not limited, and other effects may be provided.

Still further, the present technology can adopt the following configurations.

(1)

A sound processing device including a correction unit which corrects a sound pickup signal which is obtained by picking up a sound with a microphone array, on the basis of directional information indicating a direction of the microphone array.

(2)

The sound processing device according to (1), in which the directional information is information indicating an angle of the direction of the microphone array from a predetermined reference direction.

(3)

The sound processing device according to (1) or (2), in which the correction unit performs correction of a spatial frequency spectrum which is obtained from the sound pickup signal, on the basis of the directional information.

(4)

The sound processing device according to (3), in which the correction unit performs the correction at a time of spatial frequency conversion on a time frequency spectrum obtained from the sound pickup signal.

(5)

The sound processing device according to (4), in which the correction unit performs correction of an angle which indicates the direction of the microphone array in spherical harmonics used for the spatial frequency conversion, on the basis of the directional information.

(6)

The sound processing device according to (3), in which the correction unit performs the correction at a time of spatial frequency inverse conversion on the spatial frequency spectrum obtained from the sound pickup signal.

(7)

The sound processing device according to (6), in which the correction unit corrects, on the basis of the directional information, an angle indicating a direction of a speaker array which reproduces a sound based on the sound pickup signal, in spherical harmonics used for the spatial frequency inverse conversion.

(8)

The sound processing device according to any one of (1) to (7), in which the correction unit corrects the sound pickup signal according to displacement, angular velocity or acceleration per unit time of the microphone array.

(9)

The sound processing device according to any one of (1) to (8), in which the microphone array is an annular microphone array or a spherical microphone array.

(10) A sound processing method including a step of correcting a sound pickup signal which is obtained by picking up a sound with a microphone array, on the basis of directional information indicating a direction of the microphone array.

(11) A program for causing a computer to execute a processing including a step of correcting a sound pickup signal which is obtained by picking up a sound with a microphone array, on the basis of directional information indicating a direction of the microphone array.

REFERENCE SIGNS LIST

11 Recording sound field direction controller
21 Recording device
22 Reproducing device
31 Microphone array
32 Time frequency analysis unit
33 Direction correction unit
34 Spatial frequency analysis unit
42 Spatial frequency synthesizing unit
43 Time frequency synthesizing unit
44 Speaker array

The invention claimed is:

1. A sound processing device, comprising:

a correction unit that corrects a sound pickup signal, which is obtained by picking up a sound with a microphone array, based on directional information indicating a direction of the microphone array in spherical coordinates, wherein:

the correction unit corrects the sound pickup signal according to a displacement, an angular velocity, or an acceleration per unit time of the microphone array, and the correction unit performs a correction of the sound pickup signal based on a spatial frequency spectrum derived from the sound pickup signal, the correction comprising a correction of an angle in spherical harmonics, the angle corresponding to the direction of the microphone array or a direction of a speaker array through which a sound based on the sound pickup signal is to be reproduced.

2. The sound processing device according to claim 1, wherein the directional information is information indicating an angle of the direction of the microphone array from a predetermined reference direction.

3. The sound processing device according to claim 2, wherein the angle of the direction of the microphone array is a rotation angle comprising:

an elevational angle $\theta$, and an azimuthal angle $\varphi$.

4. The sound processing device according to claim 1, wherein:

the correction unit performs a spatial frequency conversion on a time frequency spectrum obtained from the sound pickup signal, to obtain the spatial frequency spectrum, and the correction unit performs the correction at a time of the spatial frequency conversion.

5. The sound processing device according to claim 1, wherein the angle in spherical harmonics, corrected by the correction unit, indicates the direction of the microphone array.

6. The sound processing device according to claim 1, wherein:

the correction unit performs a spatial frequency inverse conversion on the spatial frequency spectrum derived from the sound pickup signal, to obtain a time frequency spectrum, and the correction unit performs the correction at a time of the spatial frequency inverse conversion.

7. The sound processing device according to claim 6, wherein the angle in spherical harmonics, corrected by the correction unit, indicates a direction of the speaker array through which a sound based on the sound pickup signal is to be reproduced.

8. The sound processing device according to claim 1, wherein the microphone array is an annular microphone array or a spherical microphone array.

9. A sound processing method, comprising:

correcting a sound pickup signal, which is obtained by picking up a sound with a microphone array, to produce a corrected sound signal based on directional information indicating a direction of the microphone array in spherical coordinates, wherein:

the correcting corrects the sound pickup signal according to a displacement, an angular velocity, or an acceleration per unit time of the microphone array, and the correcting performs a correction of the sound pickup signal based on a spatial frequency spectrum derived from the sound pickup signal, the correction comprising a correction of an angle in spherical harmonics, the angle corresponding to the direction of the microphone array or a direction of a speaker array through which a sound based on the sound pickup signal is to be reproduced.

10. The sound processing method according to claim 9, wherein:

the correcting is comprised of performing a spatial frequency conversion on a time frequency spectrum obtained from the sound pickup signal, to obtain the spatial frequency spectrum, and the correction is performed at a time of the spatial frequency conversion.

11. The sound processing method according to claim 9, wherein the angle in spherical harmonics indicates the direction of the microphone array.

12. The sound processing method according to claim 9, wherein:

the correcting is comprised of performing a spatial frequency inverse conversion on the spatial frequency spectrum derived from the sound pickup signal, to obtain a time frequency spectrum, and the correcting is comprised of performing the correction at a time of the spatial frequency inverse conversion.

13. The sound processing method according to claim 12, wherein the angle in spherical harmonics indicates a direction of the speaker array through which a sound based on the sound pickup signal is to be reproduced.

14. A non-transitory computer-readable storage medium storing code for a program that, when executed by a computer, causes the computer to perform a sound processing method, the method comprising:

correcting a sound pickup signal, which is obtained by picking up a sound with a microphone array, to produce a corrected sound signal based on directional information indicating a direction of the microphone array in spherical coordinates, wherein:

the correcting corrects the sound pickup signal according to a displacement, an angular velocity, or an acceleration per unit time of the microphone array, and the correcting performs a correction of the sound pickup signal based on a spatial frequency spectrum derived from the sound pickup signal, the correction comprising a correction of an angle in spherical harmonics, the angle corresponding to the direction of the microphone array or a direction of a speaker array through which a sound based on the sound pickup signal is to be reproduced.

15. The non-transitory computer-readable storage medium according to claim 14, wherein:

the correcting is comprised of performing a spatial frequency conversion on a time frequency spectrum obtained from the sound pickup signal, to obtain the spatial frequency spectrum, and the correction is performed at a time of the spatial frequency conversion.

16. The non-transitory computer-readable storage medium according to claim 14, wherein the angle in spherical harmonics indicates the direction of the microphone array.

17. The non-transitory computer-readable storage medium according to claim 14, wherein:

the correcting is comprised of performing a spatial frequency inverse conversion on the spatial frequency spectrum derived from the sound pickup signal, to obtain a time frequency spectrum, and the correcting is comprised of performing the correction at a time of the spatial frequency inverse conversion.

* * * * *